US012546328B2

(12) United States Patent
Cartwright

(10) Patent No.: US 12,546,328 B2
(45) Date of Patent: Feb. 10, 2026

(54) CONFIGURABLE MOUNTING BRACKET FOR CEILING FANS AND LIGHTS

(71) Applicant: Thomas Cartwright, Stuart, FL (US)

(72) Inventor: Thomas Cartwright, Stuart, FL (US)

( * ) Notice: Subject to any disclaimer, the term of this patent is extended or adjusted under 35 U.S.C. 154(b) by 0 days.

(21) Appl. No.: 18/921,353

(22) Filed: Oct. 21, 2024

(65) Prior Publication Data

US 2025/0043794 A1 Feb. 6, 2025

Related U.S. Application Data

(63) Continuation-in-part of application No. 18/513,389, filed on Nov. 17, 2023, now Pat. No. 12,123,423.

(60) Provisional application No. 63/577,396, filed on Apr. 24, 2023, provisional application No. 63/577,286, filed on Apr. 14, 2023, provisional application No. 63/475,612, filed on Nov. 25, 2022.

(51) Int. Cl.
*F04D 25/08* (2006.01)
*F04D 29/60* (2006.01)

(52) U.S. Cl.
CPC ..... *F04D 25/088* (2013.01); *F04D 29/601* (2013.01)

(58) Field of Classification Search
None
See application file for complete search history.

(56) References Cited

U.S. PATENT DOCUMENTS

| | | | | |
|---|---|---|---|---|
| 6,997,740 | B2 * | 2/2006 | Kerr | F04D 29/601 439/537 |
| 8,215,920 | B2 | 7/2012 | Criner et al. | |
| 8,231,403 | B2 * | 7/2012 | Smith | H01R 13/625 439/529 |
| 8,354,948 | B2 | 1/2013 | Priest | |
| 10,890,191 | B2 | 1/2021 | Broughman et al. | |
| 2002/0111063 | A1 * | 8/2002 | Kerr | F04D 25/088 439/545 |
| 2010/0134341 | A1 | 6/2010 | Priest | |
| 2010/0329885 | A1 | 12/2010 | Criner et al. | |
| 2012/0052722 | A1 * | 3/2012 | Smith | H01R 13/625 439/529 |
| 2015/0090858 | A1 | 4/2015 | Broughman et al. | |

FOREIGN PATENT DOCUMENTS

KR 20230130345 A * 9/2023

OTHER PUBLICATIONS

KR-20230130345-A description machine translation.*

* cited by examiner

*Primary Examiner* — Juan G Flores
(74) *Attorney, Agent, or Firm* — The Concept Law Group, PA; Scott D. Smiley; Scott M. Garrett

(57) ABSTRACT

An alignable single-step mechanical/electrical mounting assembly includes an interior mounting bracket that is operable to be rotationally selectively securable to the interior of the mounting cover so that an electrical device coupled to the mounting cover will be aligned with a wall or ceiling after the second half of the mechanical couple mates with the first half of the mechanical couple and the second half of the electrical couple electrically couples with the first half of the electrical couple.

16 Claims, 20 Drawing Sheets

CONFIGURABLE MOUNTING BRACKET FOR CEILING FANS AND LIGHTS

CROSS-REFERENCE TO RELATED APPLICATION

This application is a continuation in part of and claims priority to U.S. application Ser. No. 18/513,389, filed Nov. 17, 2023, which claims priority to U.S. Provisional Patent Application No. 63/475,612 filed Nov. 25, 2022, U.S. Provisional Patent Application No. 63/577,286 filed Apr. 14, 2023, and U.S. Provisional Patent Application No. 63/577,396 filed Apr. 24, 2023, the entireties of which are all incorporated herein by reference.

FIELD OF THE INVENTION

The present invention relates generally to electrical junction boxes, and, more particularly, relates to devices, systems, and methods of mounting electrical fixtures to installed electrical junction boxes by mechanically and electrically connecting the two structures in a single step and doing so in a way that ensures the electrical fixture is selectively properly aligned, as intended by the installer.

BACKGROUND OF THE INVENTION

Co-owned U.S. application Ser. No. 18/513,289 discloses a single-step mechanical/electrical ceiling fan/light mounting assembly, such as assembly 700 shown in FIG. 7 herein. That assembly 700 includes a below-the-ceiling junction box 100 (shown in FIG. 6 herein) that has a first half of a mechanical couple 106 (shown in FIG. 1 herein) and a first half of an electrical couple 112 (also shown in FIG. 1 herein). A corresponding cover assembly 500 (shown in FIG. 5 herein) has a ceiling fan mounting bracket 501, a second half of the mechanical couple 408*a-d* that is shaped to mate with the first half of the mechanical couple 106, and a second half of the electrical couple 410 that electrically couples with the first half of the electrical couple 112 as the second half of the mechanical couple 408*a-d* mates with the first half of the mechanical couple 106.

Although the novel invention described in co-owned U.S. application Ser. No. 18/513,289 solves many problems in the prior art installation methods and devices, a problem remains with regard to achieving proper alignment of the electrical fixtures.

Typically, electrical junction boxes for wall lights are architecturally specified to be pre-mounted inside of walls and are intended to receive a wall light that will be mounted using these various accessory hardware pieces supplied by the lighting manufacturer. Until now, wall lights or sconces have needed various adapter accessory plates, bars, and other mounting hardware to adapt to the various electrical junction box configurations for the mounting of wall light fixtures. These accessories are needed to adapt the wall fixtures to the various screw hole locations or configurations on a variety of electrical junction boxes used for connecting electrical wires and for the mounting of the light fixture to the wall.

Professional electricians know that there are at least four main electrical junction boxes used for mounting wall lights. Each of these boxes has different screw hole patterns within the junction boxes that are intended to receive mounting screws for various adaptive accessory hardware, such as screw hole adapter rings, mounting bars, swivel bars, and other additional hardware pieces to be able to mount electrical wall light fixtures. This is the common way that wall lighting fixtures are currently mounted in the electrical industry.

As a result of having these various types of electrical junction boxes, which also have a variety of screw hole patterns in them that are required for the mounting of the lights, manufacturers have had to supply a variety of hardware pieces for adapting their light fixtures to electrical junction boxes. The lights cannot be mounted to the wall without these adaptive hardware pieces.

Further requiring these additional hardware pieces for installation, electrical junction boxes installed in walls are not always placed in a level position to allow the finished wall light to be level or vertically plumb. That is why there has been a need for the various types of adapter rings/plates, bars, and various additional hardware pieces to be included with the light fixture to attach to the wall and to be able to line up with these different types of junction boxes and their various hole patterns. All these adjustments must be made so that the light, when finally installed, will be in a true vertical position, as intended. These adjustments require hardware and time on the part of the installer, each leading to an increase in cost.

Therefore, a need exists to overcome the problems with the prior art as discussed above.

SUMMARY OF THE INVENTION

The invention provides an electrical device mounting bracket that overcomes the aforementioned disadvantages of the heretofore-known devices and methods of this general type, allowing the electrical device to be quickly mounted in a position that is in conformance with the installer's desired alignment.

With the foregoing and other objects in view, one general aspect of the present invention includes an alignable single-step mechanical/electrical mounting assembly that features a below-the-ceiling junction box with a substrate mounting surface defining a first mounting opening sized and shaped to receive a first mounting member, and a second mounting opening sized and shaped to receive a second mounting member. The assembly also includes a first half of a mechanical couple; and a first half of an electrical couple; a cover assembly, having: a mounting cover; and an interior mounting bracket rotationally selectively securable to an interior of the mounting cover, the interior mounting bracket having: a second half of the mechanical couple that is shaped to mate with the first half of the mechanical couple; and a second half of the electrical couple that electrically couples with the first half of the electrical couple as the second half of the mechanical couple mates with the first half of the mechanical couple. The assembly also includes at least one mounting member selectively securing the interior mounting bracket to the mounting cover. The assembly also includes where the interior mounting bracket is operable to be rotationally selectively securable to the interior of the mounting cover so that an electrical device coupled to the mounting cover will be aligned with a wall or ceiling after the second half of the mechanical couple mates with the first half of the mechanical couple and the second half of the electrical couple electrically couples with the first half of the electrical couple.

Implementations may include one or more of the following features. The alignable single-step mechanical/electrical mounting assembly may include: at least one indicator on an outer surface of the cover assembly, the indicator being positioned at a location where alignment between the indicator and the interior mounting bracket results in alignment with the electrical device coupled to the mounting cover and the wall or ceiling, after the second half of the mechanical couple mates with the first half of the mechanical couple and the second half of the electrical couple electrically couples with the first half of the electrical couple. The at least one indicator is at least three indicators on the outside surface of the cover assembly and each of the at least three indicators are positioned at locations where alignment between one of the at least three indicators and the interior mounting bracket results in a different alignment between the electrical device coupled to the mounting cover and the wall or ceiling, after the second half of the mechanical couple mates with the first half of the mechanical couple and the second half of the electrical couple electrically couples with the first half of the electrical couple. The second mounting opening is sized and shaped to slidably engage with the second mounting member in a direction substantially perpendicular to a direction directly towards the first mounting opening. The alignable single-step mechanical/electrical mounting assembly may include: a rail; and a rail attachment member slidably engaged with the rail and coupling the substrate mounting surface to the rail. The alignable single-step mechanical/electrical mounting assembly may include: a gasket at least partially surrounding an edge of the mounting cover that mates with the wall or ceiling. The alignable single-step mechanical/electrical mounting assembly may include: an edge of the mounting cover defining a weep hole.

One general aspect includes a method for installing an electrical mounting assembly providing a below-the-ceiling junction box that includes: a substrate mounting surface defining: a first mounting opening sized and shaped to receive a first mounting member, and a second mounting opening sized and shaped to receive a second mounting member. The method also includes a first half of a mechanical couple; and a first half of an electrical couple; providing a cover assembly that includes: a mounting cover; and an interior mounting bracket rotationally selectively securable to an interior of the mounting cover, the interior mounting bracket having: a second half of the mechanical couple that is shaped to mate with the first half of the mechanical couple; and a second half of the electrical couple that electrically couples with the first half of the electrical couple as the second half of the mechanical couple mates with the first half of the mechanical couple. The method also includes attaching the substrate mounting surface of the below-the-ceiling junction box to a substrate; and rotationally selectively securing the interior mounting bracket to the interior of the mounting cover in a user-selectable orientation with respect to a rotational alignment between the interior mounting bracket and the mounting cover so that an electrical device coupled to the mounting cover will be aligned with a wall or ceiling after the second half of the mechanical couple mates with the first half of the mechanical couple and the second half of the electrical couple electrically couples with the first half of the electrical couple.

Implementations may include one or more of the following features. The method may include: positioning at least one indicator on an outer surface of the cover assembly at a location where alignment between the indicator and the interior mounting bracket results in alignment with the electrical device coupled to the mounting cover and the wall or ceiling, after the second half of the mechanical couple mates with the first half of the mechanical couple and the second half of the electrical couple electrically couples with the first half of the electrical couple. The at least one indicator is at least three indicators on the outside surface of the cover assembly and each of the at least three indicators are positioned at locations where alignment between one of the at least three indicators and the interior mounting bracket results in a different alignment between the electrical device coupled to the mounting cover and the wall or ceiling, after the second half of the mechanical couple mates with the first half of the mechanical couple and the second half of the electrical couple electrically couples with the first half of the electrical couple. The step of attaching the substrate mounting surface of the below-the-ceiling junction box to a substrate may include: placing the below-the-ceiling junction box against the substrate; inserting the first mounting member through the first mounting opening and into the substrate; inserting the second mounting member through the second mounting opening and into the substrate; slidably adjusting the below-the-ceiling junction box relative to the first mounting member to achieve a desired alignment; and fixedly attaching the below-the-ceiling junction box to the substrate by tightening the first mounting member. The substrate is a rail and the method includes the steps of: attaching the below-the-ceiling junction box to the rail with a rail attachment member; sliding the below-the-ceiling junction box to a desired position along the rail; and securing the below-the-ceiling junction box to the rail with the rail attachment member. The method may include: providing a gasket at an edge of the mounting cover.

One general aspect includes an alignable single-step mechanical/electrical mounting assembly junction box having: a first half of a mechanical couple; and a first half of an electrical couple; a cover assembly, having: a mounting cover; and an interior mounting bracket rotationally selectively securable to an interior of the mounting cover, the interior mounting bracket having: a second half of the mechanical couple that is shaped to engage with the first half of the mechanical couple; and a second half of the electrical couple that is shaped to engage with the first half of the electrical couple.

Implementations may include one or more of the following features. The alignable single-step mechanical/electrical mounting assembly where: when the interior mounting bracket is selectively secured to the interior of the mounting cover and the second half of the mechanical couple mates with the first half of the mechanical couple and the second half of the electrical couple electrically couples with the first half of the electrical couple, an electrical device coupled to the mounting cover is aligned with a wall, ceiling, or floor. The alignable single-step mechanical/electrical mounting assembly may include: at least one indicator on an outer surface of the cover assembly, the indicator being positioned at a location where alignment between the indicator and the interior mounting bracket results in alignment with the electrical device coupled to the mounting cover and the wall or ceiling, after the second half of the mechanical couple mates with the first half of the mechanical couple and the second half of the electrical couple electrically couples with the first half of the electrical couple. configurable mounting bracket for ceiling fans and lights.

Although the invention is illustrated and described herein as embodied in a configurable mounting bracket for ceiling fans and lights, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic of the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting but rather to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up," "down," "left," "right," "inside," "outside," "front," "back," "head," "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. Those skilled in the art can understand the specific meanings of the above-mentioned terms in the embodiments of the present invention according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
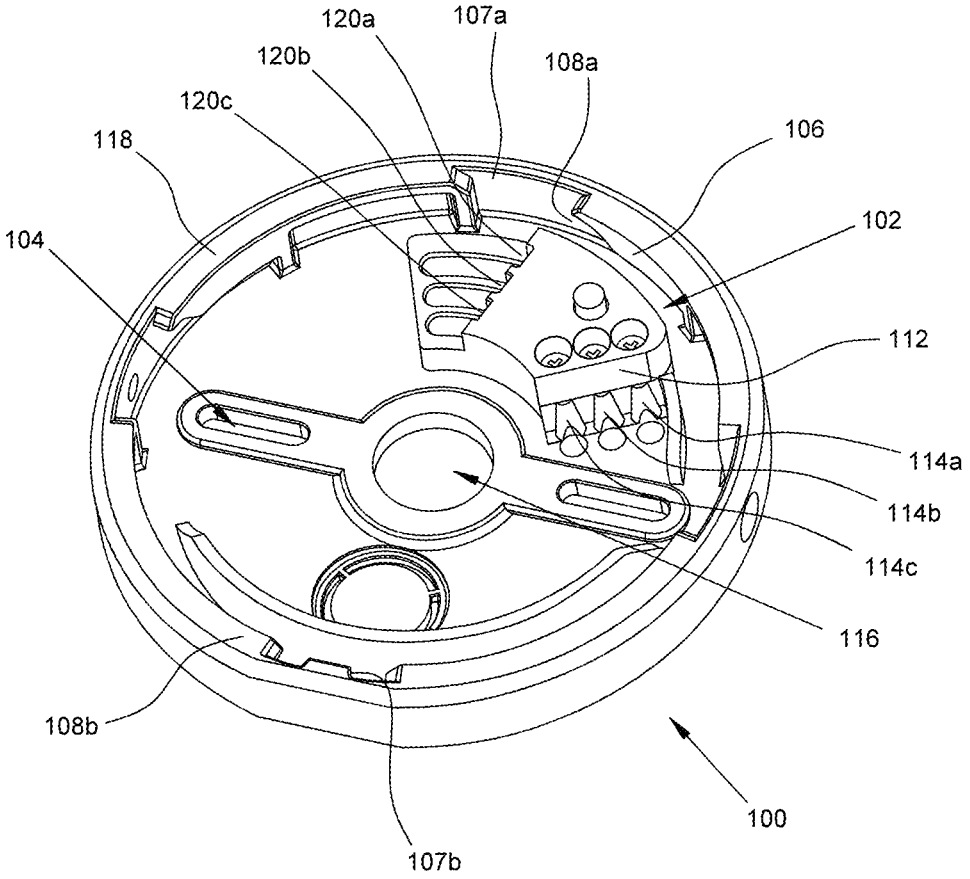
FIG. 1 is a perspective view of the interior of a below-the-ceiling junction box, in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient junction box cover that secures a light, fan or other electrical device to the junction box and that is adjustable so that, when secured to the junction box, it is aligned in accordance with the installer's preference.

Figure 2:
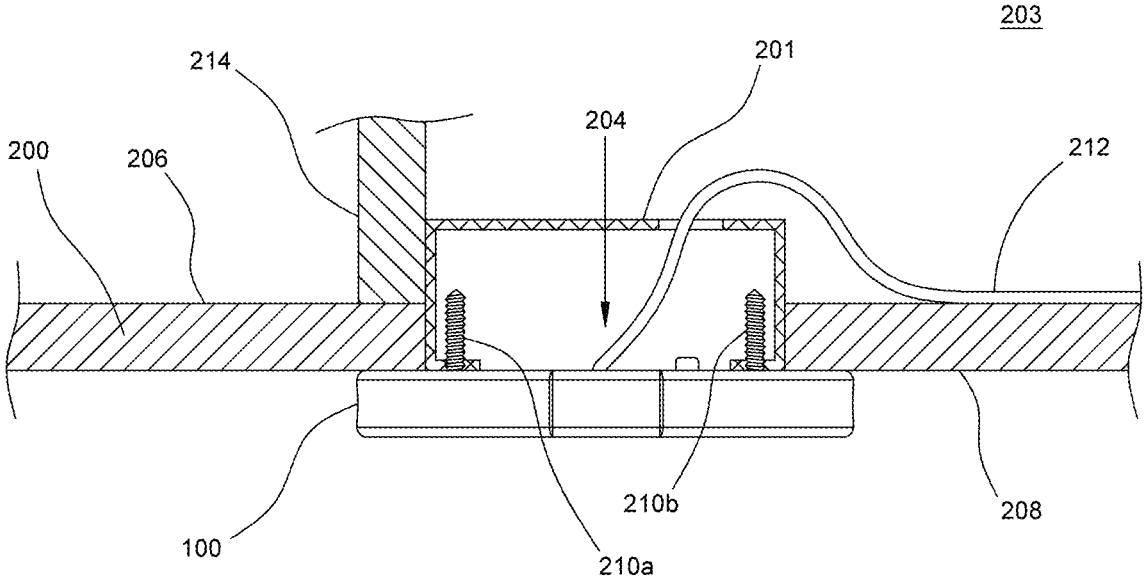
FIG. 2 is an elevational side view of the below-the-ceiling junction box of FIG. 1 coupled to a ceiling, in accordance with the present invention.

Referring now to FIG. 1, one embodiment of the present invention is shown in a perspective view of the inside of a below-the-ceiling junction box 100. FIG. 1 shows several advantageous features of the present invention but, as will be described below, the invention can be provided in several shapes, sizes, combinations of features and components, and varying numbers and functions of the components. The first example of a below-the-ceiling junction box 100, as shown in FIG. 1, includes an interior area 102. This interior area 102 includes at least one location 104, which is an aperture for anchoring the below-the-ceiling junction box 100 to a ceiling, as will be described below and is illustrated in FIG. 2. There can be multiple locations 104 within the interior area 102 for this purpose. The interior area 102 of the below-the-ceiling junction box 100 also includes a first half of a mechanical couple 106. As illustrated in FIG. 1, the first half of the mechanical couple 106 is a receiving portion 107*a* that transitions into a slanted female receiving slot 108*a* along an inner surface of an outer edge 118 of the below-the-ceiling junction box 100. The mechanical couple 106 is able to receive a male portion of another mechanical part, which will be described below and illustrated in FIGS. 1-8. The first half of the mechanical couple 106 has a second receiving portion 107*b* and a second slanted female receiving slot 108*b* opposite the receiving portion 107*a* and slot 108*a*, which also receives a male portion of a mechanical part, as described below. The below-the-ceiling junction box 100 can have additional receiving portions and female receiving slots as well, in some embodiments, there are four. In other embodiments, the mechanical couple 106 can be male and couple to a female portion of another part of the present invention that features the female portions.

The interior area 102 of the below-the-ceiling junction box 100 also features a first half of an electrical couple 112. The particular embodiment of the first half of the electrical couple 112 of FIG. 1 is illustrated as a terminal block that has three wire terminals 114*a-c*. The terminal block is not limited to only three wire terminals. In the embodiment illustrated, the wire terminals 114*a-c* are standard electrical wire receivers that accept the stripped end of insulated wires (not shown) and provide gripping tension that prevents the wires from being released from the terminal block 112, absent significant force or release via a mechanical release mechanism that must be manually manipulated, e.g., pushed with a tool or unscrewed. The first half of the electrical couple 112 can be provided in other embodiments as well with different structures for securing wires. The electrical connections can be done by secure engagement of contact surfaces alone, not only being made by male and female prongs or blades.

Figure 6:
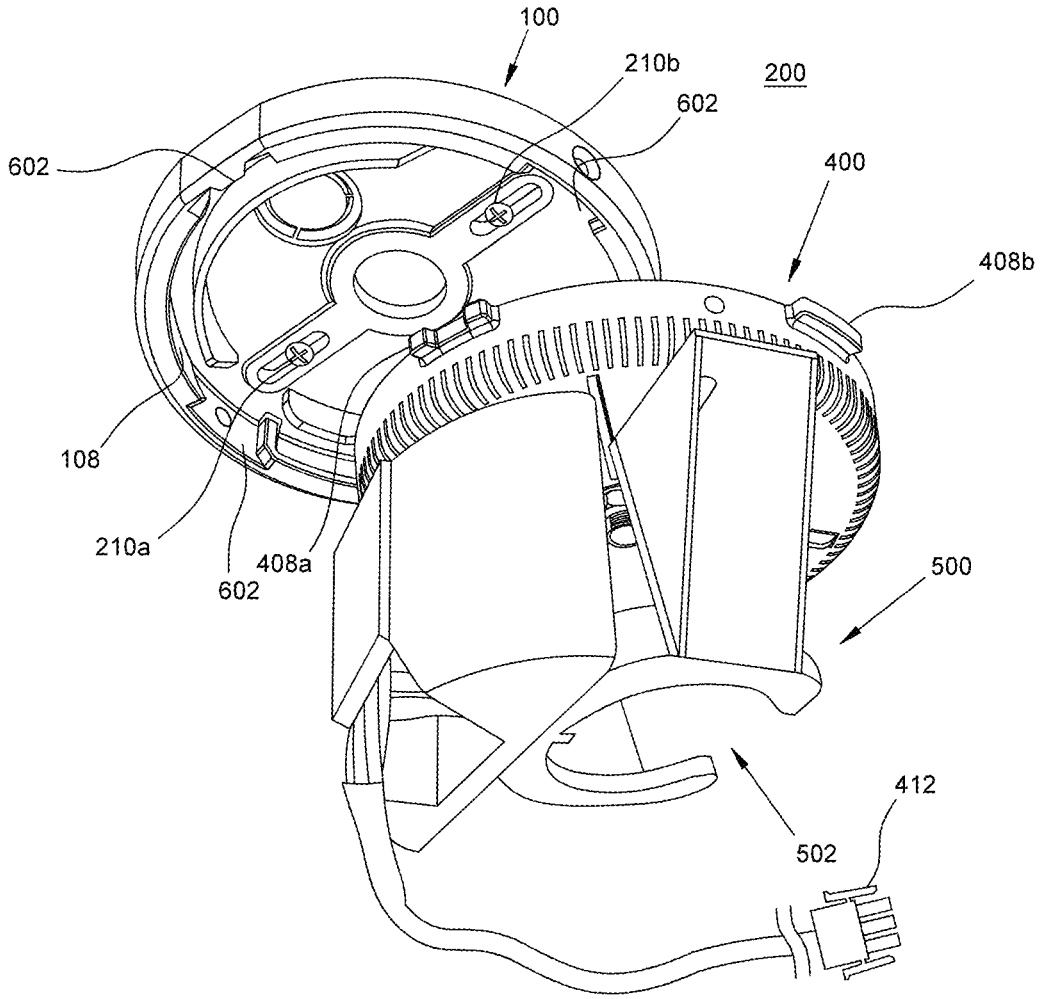
FIG. 6 is a perspective upward-looking view at the below-the-ceiling junction box of FIG. 1 coupled to a ceiling and the cover of FIGS. 4 and 5 in close proximity thereto, prior to coupling, in accordance with the present invention.
Figure 7:
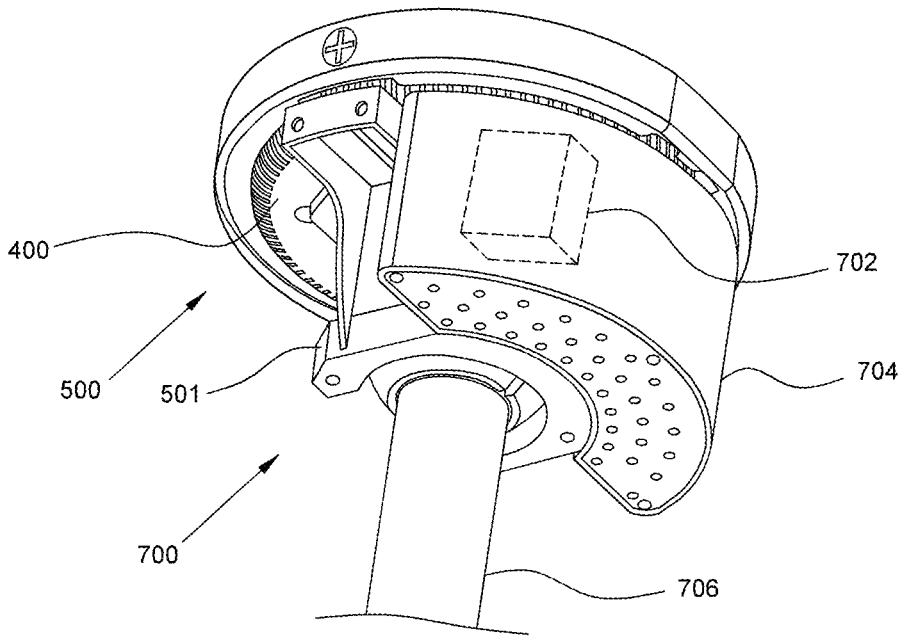
FIG. 7 is a perspective upward-looking view of the below-the-ceiling junction box of FIG. 1 coupled to the cover of FIGS. 4 and 5, in accordance with an exemplary embodiment of the present invention.
Figure 8:
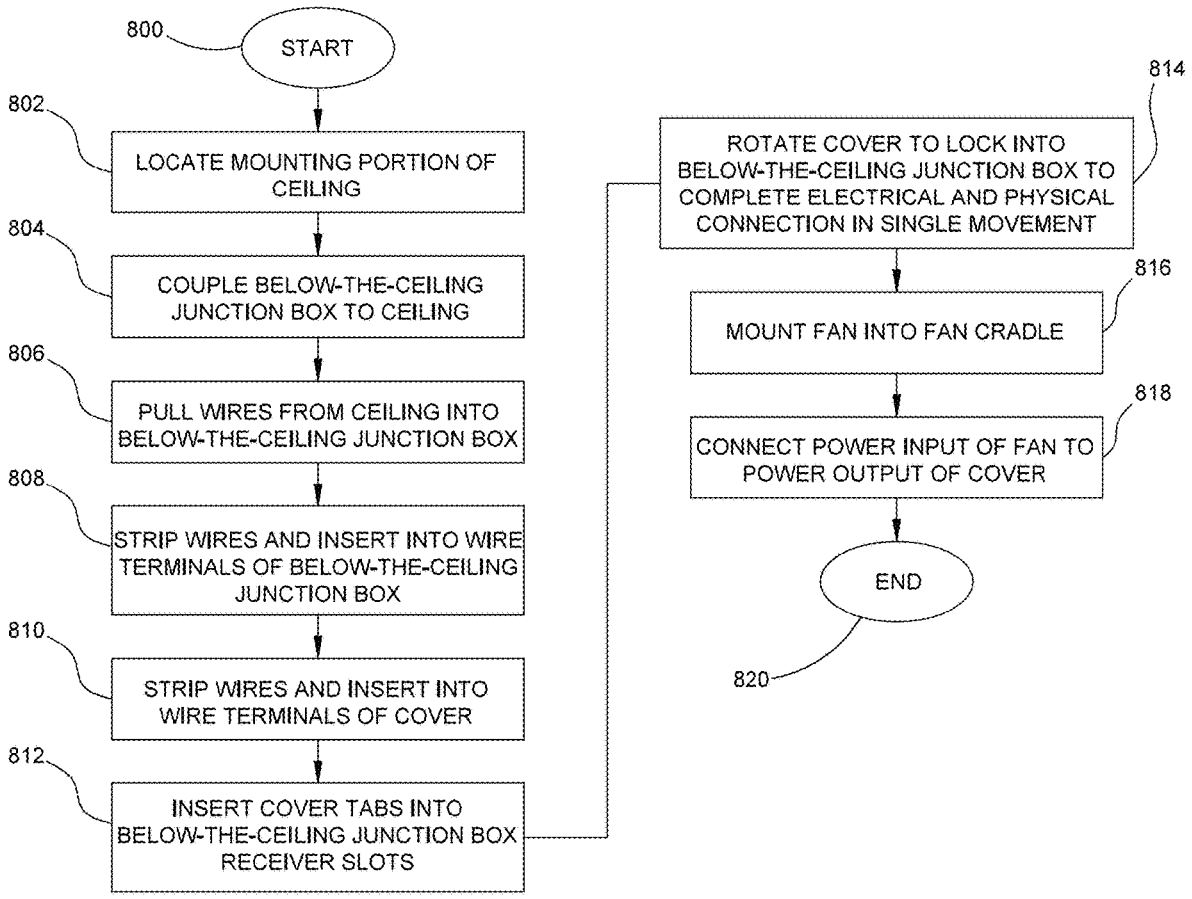
FIG. 8 is a process flow diagram showing an exemplary method of electrically and mechanically coupling a fan to a ceiling in a single step, in accordance with an exemplary embodiment of the present invention.
Figure 9:
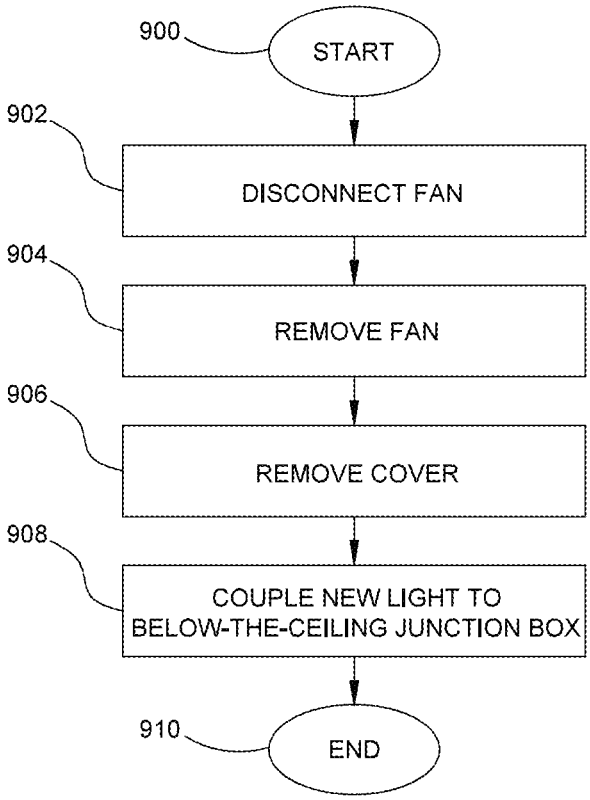
FIG. 9 is a process flow diagram showing an exemplary method of electrically and mechanically decoupling a fan from a ceiling in a single step and electrically and mechanically coupling a light fixture to a ceiling in a single step, in accordance with an exemplary embodiment of the present invention.

FIGS. 1-7 and 10 will be described in conjunction with the process flow chart of FIGS. 8 and 9. Although FIGS. 8 and 9 show a specific order of executing the process steps, the order of executing the steps may be changed relative to the order shown in certain embodiments. Also, two or more blocks shown in succession may be executed concurrently or with partial concurrence in some embodiments. Certain steps may also be omitted in FIGS. 8 and/or 9 for the sake of brevity. In some embodiments, some or all of the process steps included in FIGS. 8 and 9 can be combined into a single process.

Referring now primarily to FIGS. 2 through 7, as well as the flow chart in FIG. 8, the process for installing the below-the-ceiling junction box 100 starts at step 800 and proceeds with step 802, where a mounting portion 204 of the ceiling 200 is located by the user/installer. The term "user" will be used herein below to describe the individual installing the below-the-ceiling junction box 100; however, it should be understood that the user may be an electrician or may be the homeowner or other building resident that is intended to utilize the fan (or any apparatus that is installed). As used herein, the term "mounting portion 204" is intended to indicate a portion of the ceiling 200 on which the below-the-ceiling junction box 100 is intended to be positioned, affixed, or otherwise coupled to. In one embodiment, the mounting portion 204 of the ceiling 200 is below a standard pre-existing above-the-ceiling junction box 201. In one embodiment, the mounting portion 204 of the ceiling 200 includes a first surface 206 and a second surface 208. The first surface 206 may be opposite the second surface 208. The first surface 206 may be considered an "above-the-ceiling" surface and the second surface 208 may be considered a "below-the-ceiling" surface 208, each defining where a "below-the-ceiling" and "above-the-ceiling" area starts. That is, anywhere above the first surface is considered "above-the-ceiling" and anywhere below the second surface 208 is considered "below-the-ceiling," including walls.

In step 804, the below-the-ceiling junction box 100 is coupled to the above-the-ceiling junction box 201, which is, itself, secured to a structure 214 in the above-the-ceiling area 203. The structure 214 is able to support a ceiling fan. Such structures are generally rafters that run the length of the ceiling, but the structure 214 can include any similar support structure sufficient to hold a standard ceiling fan. In the embodiment shown in FIG. 2, a pair of screws 210*a* and 210*b* pass through apertures 104 in the below-the-ceiling junction box 100 and through portions of the above-the-ceiling junction box 201 to secure the below-the-ceiling junction box 100 to the above-the-ceiling junction box 201, leaving the below-the-ceiling junction box 100 flush against the bottom surface 208 of the ceiling 200.

In step 806, which can also take place prior to step 804, wires 212 originating above the ceiling and being present inside of the above-the-ceiling junction box 201 are routed through wire aperture 116 (shown in FIG. 1) of the below-the-ceiling junction box 100. The wires 212 include positive lead 1002 (often referred to as the "hot" lead) and negative lead 1004 (often referred to as the "ground" lead) (shown in FIG. 10) coupled to an A/C power source on the other end of wires 212. In most embodiments, a neutral wire 1006 is also part of the wires 212.

Figure 11:
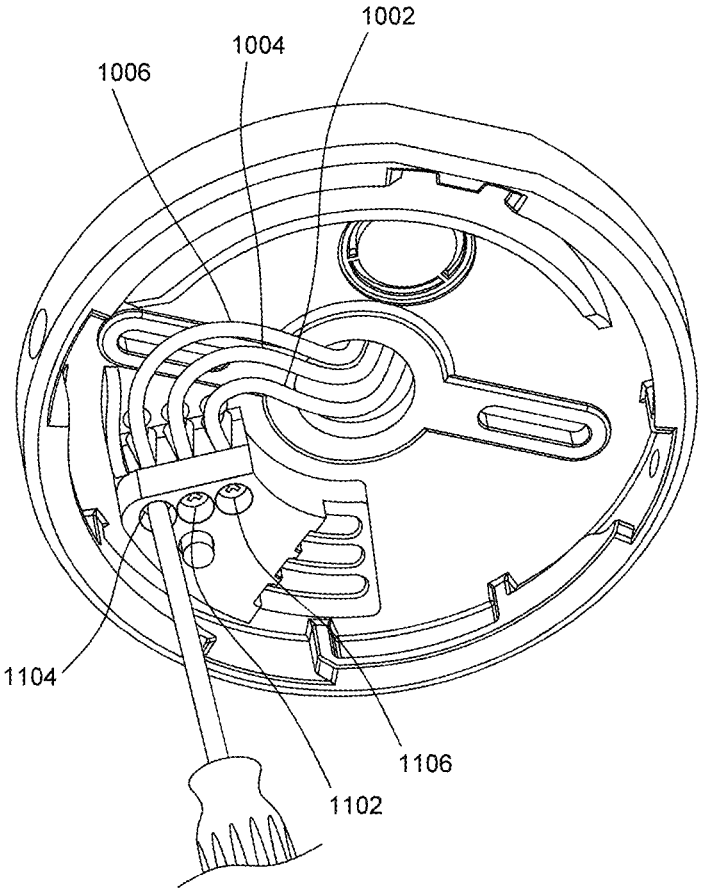
FIG. 11 is a perspective upward-looking view of the interior of the below-the-ceiling junction box showing the terminal block with screws to secure the wires coming from above the ceiling, in accordance with the present invention.

In step 808, insulation from a first one 1002 of the wires 212 is stripped and the first wire 1002, e.g., hot lead, is inserted into a first one of the three wire terminals 114*a-c*. In step 808, insulation from a second one 1004 of the wires 212 is stripped and the second wire 1004, e.g., ground lead, is inserted into a second one of the three wire terminals 114*a-c*. Also in step 808, insulation from a third one 1006 of the wires 212 is stripped and the third wire 1006, e.g., neutral lead, is inserted into a third one of the three wire terminals 114*a-c*. As is illustrated in FIG. 11, the wires 1002, 1004, 1006 can be secured by tightening screws 1102, 1104, 1106 or with a common mechanism that asserts clamp or spring pressure against the wires and prevents them from being pulled out without a release mechanism being manipulated, usually, with a separate tool.

Figure 3:
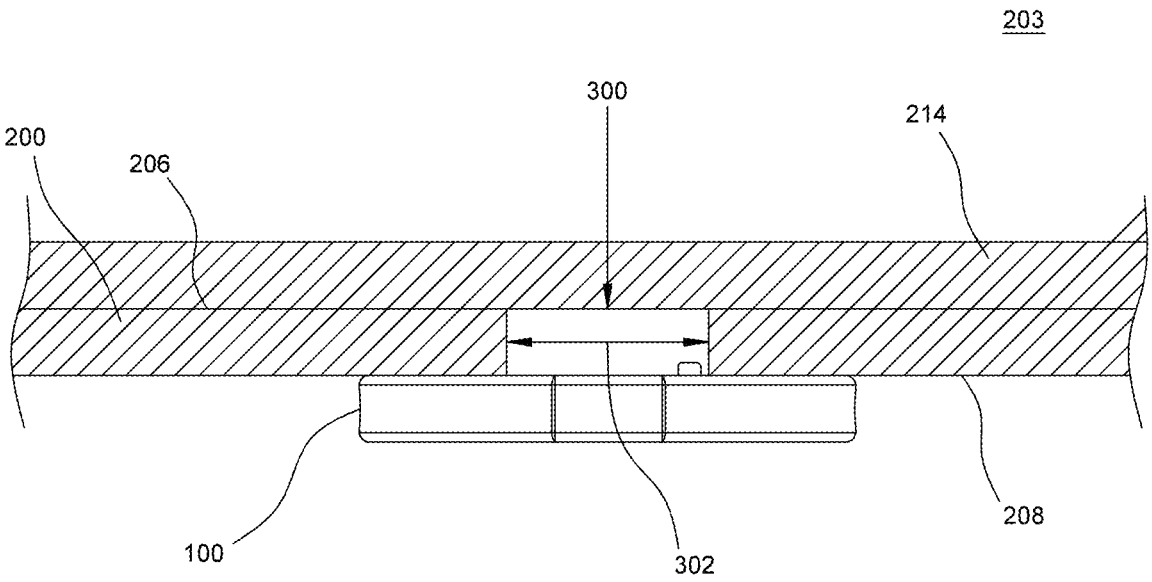
FIG. 3 is an elevational side view of the below-the-ceiling junction box of FIG. 1 coupled to a ceiling and a support structure within the ceiling, in accordance with the present invention.

In alternative embodiments, as shown in FIG. 3, the below-the-ceiling junction box 100 can be attached directly to a support structure 214 without the need for an above-the-ceiling junction box 201 (shown in FIG. 2). In this embodiment, an aperture 300 may be created by the user within the mounting portion 204 (shown in FIG. 2), forming a through-hole 300 extending through the first surface 206 and the second surface 208. The aperture 300 is preferably of a relatively small diameter, labeled 302 in FIG. 3, as compared to conventional ceiling holes for conventional ceiling mounted fan/light assemblies that couple to above-the-ceiling junction boxes 201. In a preferred embodiment, the aperture 300 is sized and shaped to insert at least one electrical conductor 212 therethrough from the above-the-ceiling area 203. In one embodiment, the aperture 300 is sized to be no greater than 2 inches at its greatest width. In another embodiment, the aperture 300 is sized to be no greater than 1 inch at its greatest width. In other embodiments, the aperture 300 may be outside of these ranges. The aperture 300 may be created by any known method or device, such as, for example, a drill. In this embodiment, screws, such as wood screws, could be used to attach the below-the-ceiling junction box to a support structure 214 in the above-the-ceiling area 203. Once attached, the wires are stripped and terminated in the terminal block 112 as described above.

Figure 4:
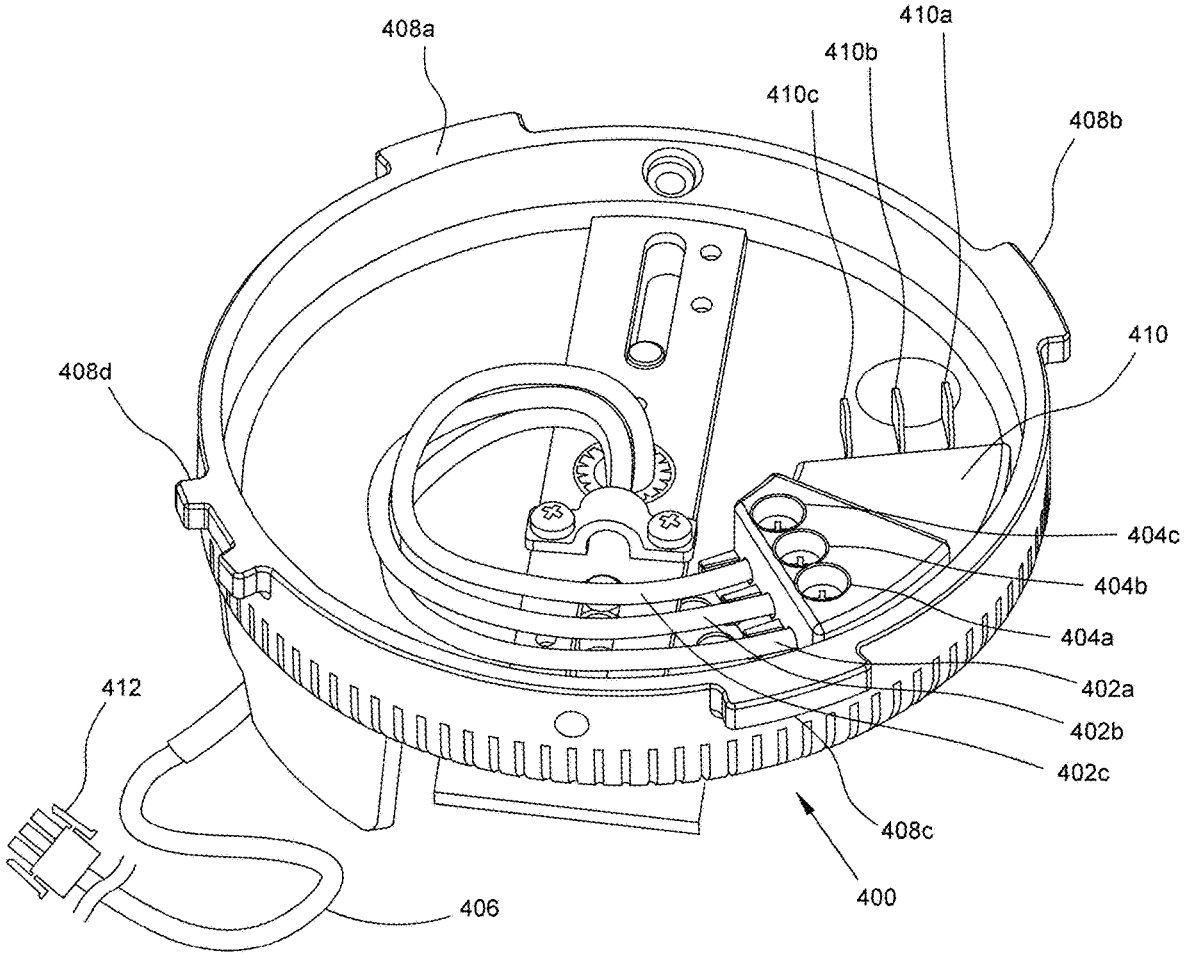
FIG. 4 is a perspective view of the interior of a cover for the below-the-ceiling junction box of FIG. 1, in accordance with the present invention.

FIG. 4 shows a bottom cover 400 that attaches to the below-the-ceiling junction box 100. The bottom cover 400 includes a set of tabs 408*a-d*. Although four tabs 408*a-d* are shown in FIG. 4, the invention is not limited to four and can have less than or more than four. The tabs 408*a-d* are sized and shaped to fit within receiving portions 107 and mate with the female receiving slots 108 shown in FIG. 1. There can be more female receiving slots, e.g., one that corresponds to each tab 408*a-d*. Once the bottom cover 400 is inserted into the below-the-ceiling junction box 100, the tabs 408*a-d* are received within receiving areas 107 at the openings of the receiving slots 108 and a turning motion of the cover 400 mechanically couples the tabs 408*a-d* into the receiving slots 108. Any wires coming into the below-the-ceiling junction box 100 (other than wires coming directly from an above-the-ceiling electrical junction box) must be secured with Code compliant electrical wire clamping devices (such as ROMEX connectors or pipe clamps) required by the NEC for the types of electrical wires normally used for fans and lights. The below-the-ceiling junction box 100's incoming power wire "holes" are designed to accommodate the NEC approved and commonly used wire clamping devices for electrical wires. This again provides additional Code compliance for users with regard to the code compliant and safety issues required for connecting wires into electrical junction boxes.

The cover 400 also has an electrical termination block 410. The termination block 410 in the cover 400 is similarly structured as the termination block 112 shown in FIG. 1. That is, the termination block 410 has connection receivers 404*a-c* capable of separately receiving three wires 402*a-c*, e.g., black, white, and neutral, from a power bundle 406 with a power connector 412. The power connector 412 can be a standard plug connector that is sized and shaped to match a companion power connector of a fan (not illustrated). For example, if the power connector 412 is a female, the power connector of the fan is a corresponding male plug. Therefore, returning the process flow diagram of FIG. 8, in step 810, an end of wire 402*a* is stripped and inserted into the first wire terminal 404*a*. In that same step, an end of a second one of the wires 402*b* is stripped and the second wire 402*b* is inserted into a second one of the three wire terminals 404*b* and, if a neutral wire is present, an end of the neutral wire 402*c* is stripped and the third/neutral wire 402*c* is inserted into a third one of the three wire terminals 404*c*. The wires 402*a-c* can be secured by tightening screws (shown in FIG. 4) or with a common mechanism that asserts spring pressure against the wires and prevents them from being pulled out without a release mechanism being manipulated or significant pulling force. The termination block 410 in the cover 400 can also serve as a connector for a remote-control. Wires 212 supply power to the assembly, including, e.g., WIFI, RF, Bluetooth, and more. In some embodiments, the end user does not need to complete step 810 because this step occurs at the manufacturer so that the cover is provided to the end user with wire 406 pre-installed/pre-terminated in terminal block 410. In other embodiments, the present invention is a retrofit product and the user will make these wire connections themselves when they retrofit a common "off the shelf" fan or light they have purchased and one that is not OEM prepared or connected. In this embodiment, the present invention is a stand-alone product that is easily adaptable to existing lights or fans without pre-existing OEM connections. In addition, components, such as wireless receivers can also be connected to the wires 402*a-c* directly and without using the terminal block 410. The terminal block 401 in the cover 400 of the below-the-ceiling junction box 100 can also serve as a connector for a remote-control receiver and/or other device capable of wireless communication, e.g., WIFI, RF, Bluetooth, and more. The terminal block 410 can have additional receiving ports in addition to the illustrated ports 404*a-c*. These additional ports can facilitate the connections the additional alternative components described above.

Figure 5:
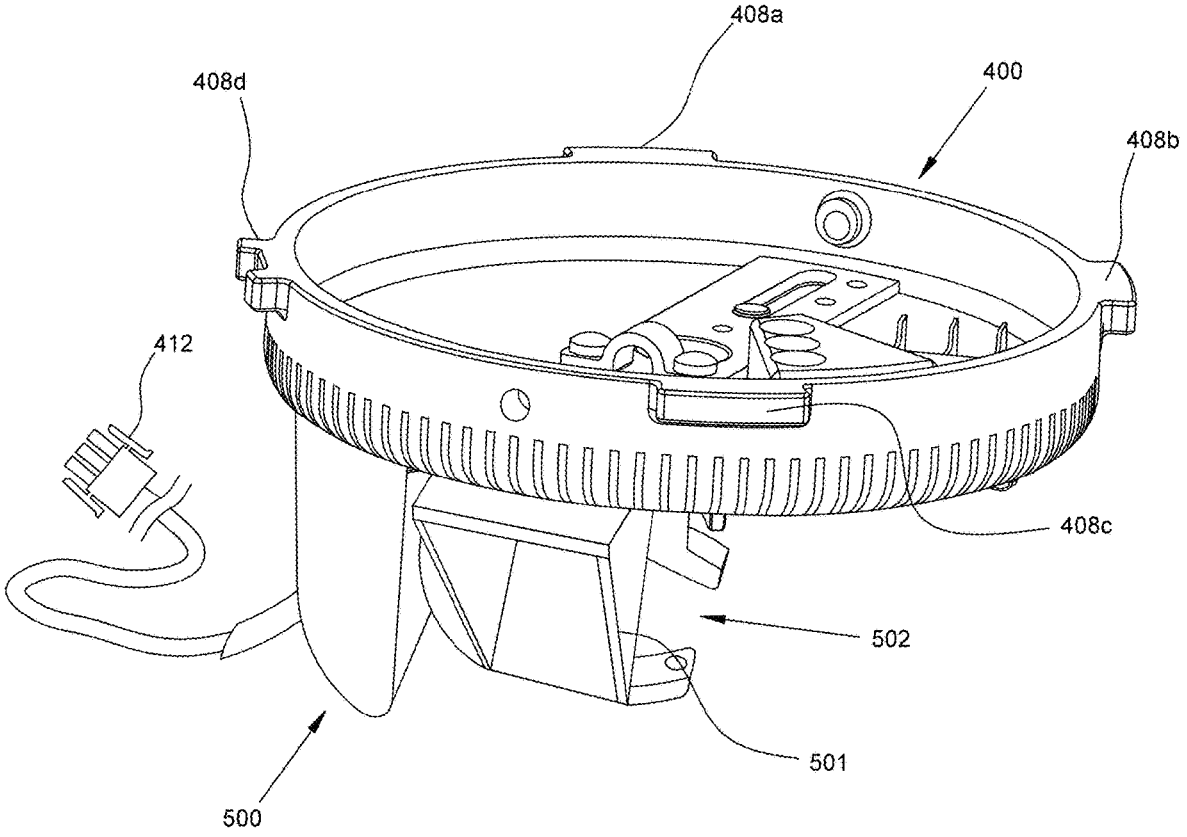
FIG. 5 is a perspective side view of the cover of FIG. 4 with a fan mount bracket attached thereto, in accordance with the present invention.

FIG. 5 shows a perspective side view of a cover assembly 500, which includes the cover 400 of FIG. 4, and a ceiling fan mounting bracket 501 attached to the bottom of the cover 400. The ceiling fan mounting bracket 501 is any structure that can hold a fan proximate to a ceiling and, in the particular embodiment shown in FIG. 5, includes a socket 502 that is shaped and sized to receive a standard ball connector (not shown) that is present on most common down rod ceiling fans' support shafts. The socket 502 provides a cradle that holds a standard fan's ball connector securely, while also allowing it to rotate/move within the socket 502. The rotation/movement is the natural result of the fan being in operation and the blades rotating, causing the fan to move. In other embodiments, the socket 502 is not required and the mounting bracket 501 has a thin profile that accepts standard flush-mount ceiling fans or lights and is a light fixture mounting bracket.

FIG. 6 shows the below-the-ceiling junction box 100 attached to a ceiling 200 and the cover 400 being proximal to the below-the-ceiling junction box 100 in preparation for the cover 400 to be installed into the below-the-ceiling junction box 100. In this step 812, at least two of the tabs 408*a-d* are aligned with and placed inside of entry points 602 of the female receiving slots 108. In step 814, the cover is rotated so that the male tabs 408*a-d* are forced into the tapered portions of the female receiving slots 108*a-b* until the cover is secured, i.e., will not separate from the below-the-ceiling junction box 100 without purposeful force/manipulation by a user. In some embodiments, the female receiving slots 108*a-b* have a portion that receives the tabs 408*a-d* and will not release them without an additional physical movement or tool. For example, a button may need to be pressed to release them or a force may need to be applied, e.g., pushing the cover further into the below-the-ceiling junction box 100 similar to a medication bottle.

At the same time as the tabs 408*a-d* are mechanically coupled to the female receiving slots 108*a-b*, the terminal block 112 of the below-the-ceiling junction box 100 makes an electrical couple to the terminal block 410 of the cover 400. This single-step electrical/physical coupling, in accordance with one embodiment, is facilitated by a first plurality of terminal connectors 410*a-c* that are part of the terminal block 410 in the cover 400. Correspondingly, the terminal block 112 of the below-the-ceiling junction box 100 has a second plurality of terminal connectors 120*a-c*. When the cover 400 is placed into the below-the-ceiling junction box 100 and rotated to physically couple with the below-the-ceiling junction box 100, the plurality of terminal connectors 410*a-c* are physically aligned with and mate with the second plurality of terminal connectors 120*a-c*. This coupling places wire terminal 114*a* of the below-the-ceiling junction box 100 in conductive coupling with wire terminal 404*a* of the cover 400 and thus places a wire terminated in wire terminal 114*a* in conductive communication with a wire 402*a* terminated in terminal 404*a*. Similarly, the coupling places wire terminal 114*b* of the below-the-ceiling junction box 100 in conductive coupling with wire terminal 404*b* of the cover 400 and thus places a wire terminated in wire terminal 114*b* in conductive communication with a wire 402*b* terminated in terminal 404*b*. The coupling also places wire terminal 114*c* of the below-the-ceiling junction box 100 in conductive coupling with wire terminal 404*c* of the cover 400 and thus places a wire terminated in wire terminal 114*c* in conductive communication with a wire 402*c* terminated in terminal 404*c*. It should be noted that the invention is not limited to just three connectors 120*a-c* in the below-the-ceiling junction box 100 or three connectors 404*a-c* in the cover 400. More specifically, additional connectors 404 can be provided in the cover for the purpose of powering additional elements, such as remote controls, additional lighting, and more.

Once installed, the below-the-ceiling junction box 100 and cover 400 form an electrical mounting bracket assembly 700, 1200 that drastically reduces safety risks and provides secure code-compliant electrical power connections. These connections are structured to eliminate the need for the extensive traditional hard wiring process, which can come loose during installation without the installer realizing or can come lose over time after installation, for example, as the fan spins and rocks back and forth. The present invention is a device and method that provides both mechanical support and electrical power supply for the installation of ceiling fans, with or without remote controls and/or other methods of wireless communications (i.e., WIFI, RF, Bluetooth, etc.).

More specifically, the present invention eliminates the need for a separate "receiver module" to be inserted into the hanger bracket or placed behind a decorative housing, as is the only option with the prior art. The present invention provides an entirely new placement, or positioning, for the receiver module that controls the remote-control functioning of various lighting products and lighted ceiling fans. In accordance with one embodiment, which is shown in FIG. 7, the receiver module 702 (operable to receive signals from a remote-control switch) has now been integrated within a compartment 704 of the cover assembly 500. This new location within which to mount the receiver module 702 connects to any downward-emitting light source powered by the electrical mounting bracket assembly 700. One application is on a standard lighted fan bracket assembly configuration where power for the light and its accompaniment wiring is extended down through a common tubular rod 706 connecting the receiver module 702 with a light that is terminally disposed at the distal end of the rod 706 and that emits a downward lighting source at the distal end. Advantageously, the compartment 704 can be removed from the assembly shown in FIG. 7 and replaced with smaller or larger assemblies, as needed to fit whatever components are contained within, e.g., remote control receivers, WIFI receivers and/or transmitters, etc. In one embodiment of the present invention, any electrical component (connected to fan or light) within the compartment 704 attaches (via 412) only to the wires coming up through the tubular rod 706.

As the cover 400 physically attaches and electrically couples (in a single step) to the below-the-ceiling junction box 100 as shown in FIG. 7, the receiver module 702 receives a source of electrical power. When this novel one-step mechanical and electrical coupling occurs, it powers the receiver module 702 to now receive an electrical signal from one of the remote switches sending commands for activation. The benefits of the present invention include reduced time on ladders, less hard wiring for lighting products, no additional hard wiring for both fan and lighting products, and ease of use by DIYers.

Figure 12:
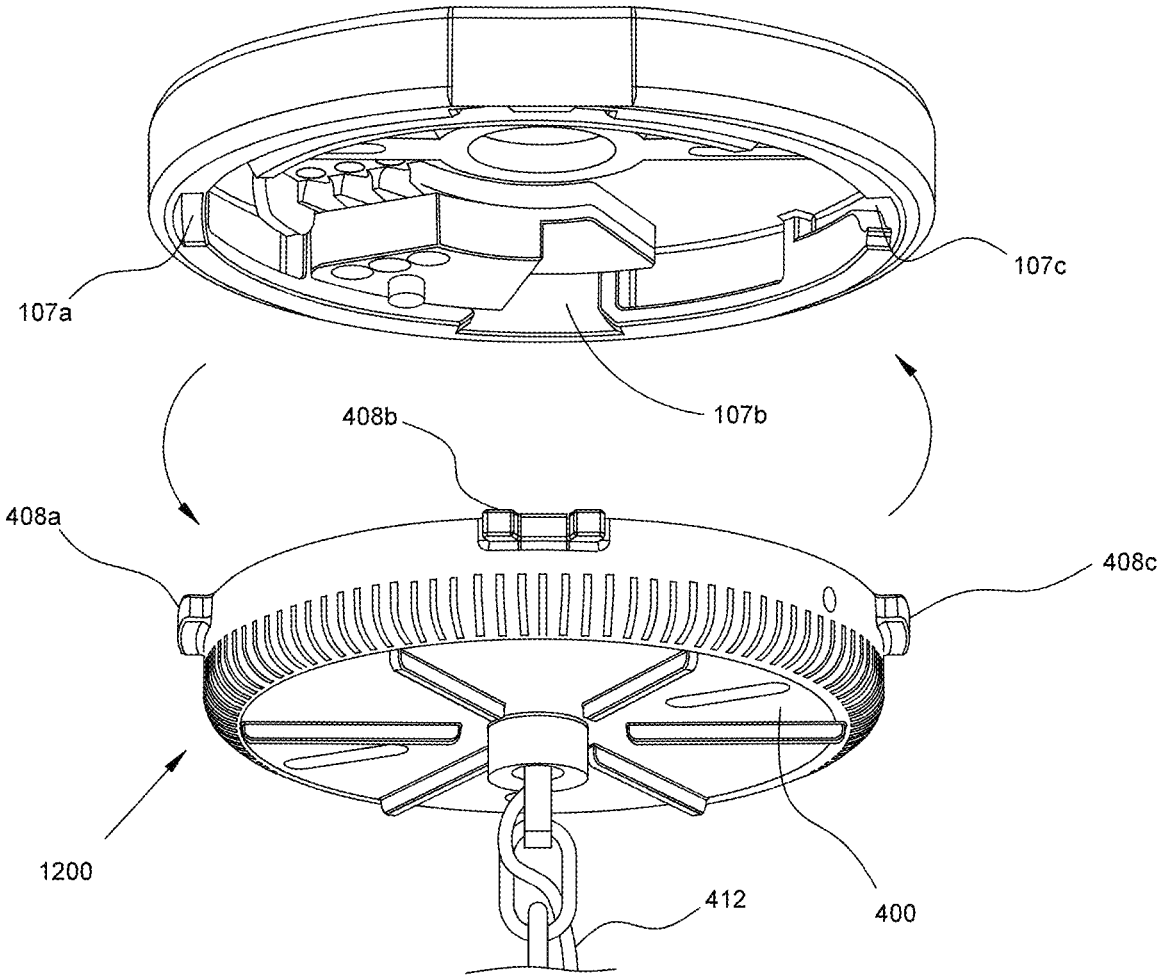
FIG. 12 is a perspective upward-looking view of a cover being physically and electrically attached to the below-the-ceiling junction box of FIG. 11 in a single movement, in accordance with the present invention.

The electrical mounting bracket assembly 1200 shown in FIG. 12 both supports the fan and has the mating electrical plug 412 to connect with the companion plug on the fan when engaged. Referring back to FIG. 8, in step 816, a portion, i.e., ball mount, of the fan (not show in the figures) is inserted within and fully physically supported by the cradle 502. In step 818, when the power input for the fan (not shown in the figures) and the plug 412 of the cover 400 are engaged with one another (twist locked or other type of interlocking method that can engage the two parts securely), the electrical mounting bracket assembly 1200 now has the electrical power onboard and within the assembly to power the fan and light and provide power to built-in electronic components that give the fan remote control and/or wireless communication (i.e. WIFI, RF, Bluetooth, etc.) capability.

The electrical mounting bracket assembly 700 or 1200, formed from the below-the-ceiling junction box 100 and the cover assembly 400, when connected together with a twist locking motion or other type of interlocking method that can engage the two parts securely, provide the weight supporting and electrical power supply (including wireless communication capability) for the operation of a ceiling fan.

The novel electrical mounting bracket assembly 700, 1200 and method for mounting a ceiling fan to the ceiling makes installations much easier and safer. The interconnecting of the electrical power between the electrical mounting bracket assembly 700, 1200 and the ceiling fan motor & light are accomplished by the use of only a "plug" type connector or other embedded electrical wire contacts (no exposed wires) coming from and within the electrical mounting bracket assembly 700, 1200. The electrical mounting bracket assembly 700, 1200 maintains an uninterrupted electrical power connection between the power source (via the below-the-ceiling junction box 100) and the fan motor, light and electronic components without having to make loose, exposed wire end or "hard wire" connections to the fan, light or electronic components when the two component parts are "twist locked" or other type of interlocking method that can engage the two parts securely and joined together.

When the below-the-ceiling junction box 100 has been secured to the ceiling surface 200 and the cover 400 is attached to the below-the-ceiling junction box 100, a fan can be placed within the cradle 502 of the ceiling fan mounting bracket 501 in the penultimate step 816 and the final step 818 is simply connecting the fan to the electrical power source, which can now be accomplished without any "hard wiring" (loose wire end connections) required. The installer simply connects the plug from the fan to a corresponding receptacle, e.g., 412.

Figure 10:
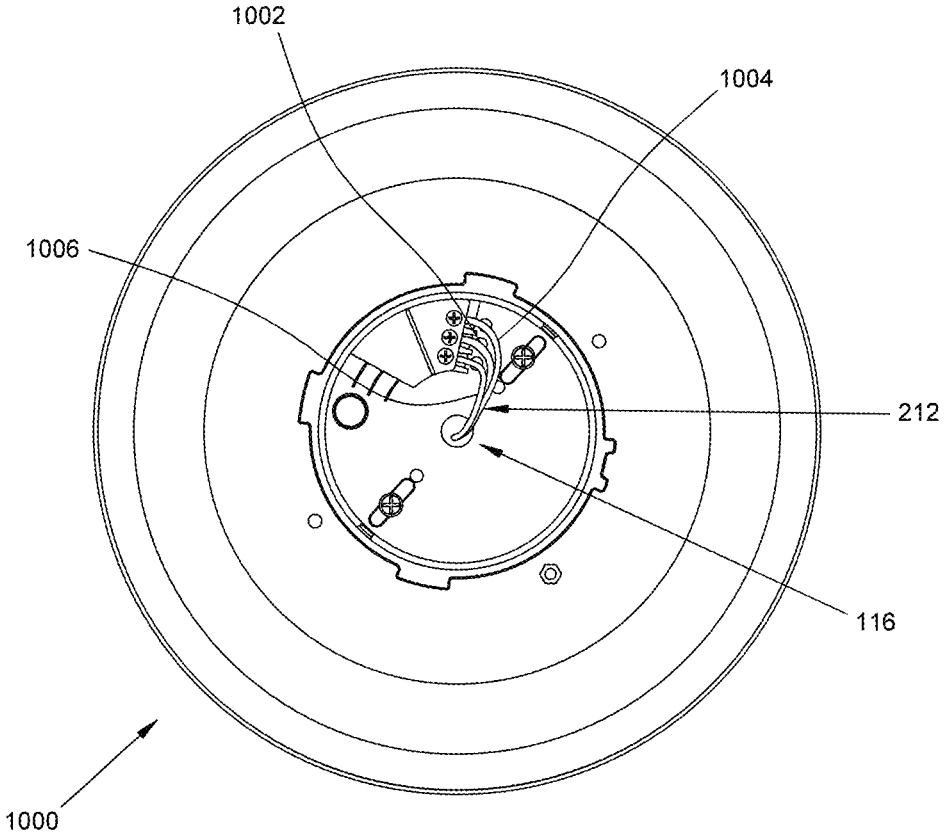
FIG. 10 is a top plan view of a light fixture coupled to a cover that physically and electrically attaches to the below-the-ceiling junction box of FIG. 1 in a single movement, in accordance with an embodiment of the present invention.

Advantageously, the present invention allows for the quickest and most convenient structure and method of replacing a ceiling fan with a light-only structure known to date (or vice versa). More specifically, if one wanted to remove a fan from their ceiling, for example, if someone installed bunk beds in their children's room and wanted to remove the hazard of spinning blades near the top bunk, The process flow chart of FIG. 9 shows the simple method. The process starts at step 900 and moves to step 902 where a fan is electrically disconnected from the plug 406. In step 904, the fan is uninstalled from the ceiling by removing it from the cradle 506. Next, in step 906, the cover 400 can be removed by simply rotating it with relation to the above-the-ceiling junction box 100. In step 908, a new cover 1000, shown in FIG. 10, is inserted within the above-the-ceiling junction box 100 and rotated to make a physical and electrical connection. The process ends at step 910. The cover 1000 is electrically similar to the cover 400 but, instead of having the ceiling fan mounting bracket 501, it has lights, e.g., LED, on its exterior (opposite to the side shown in FIG. 10) that are powered by the electrical connections of the above-the-ceiling junction box 100 once it is physically coupled to the above-the-ceiling junction box 100. The above-the-ceiling junction box 100 allows for lights, fans, and any similar structure to be installed onto ceilings within minutes and without the need for making raw electrical connections with wire nuts and stripping wires each time.

In summary, a fan motor, light and electronics (for wireless communication and other remote features) start with loose wire leads that need to be connected to a power source. The prior-art method of installing these components is difficult, dangerous, and out of favor with users and in need of replacement. The presently inventive novel device and method allow the electrical power (from fan/light to power source) to be connected safely and securely through use of the electrical mounting bracket assembly 700, 1200. An installer does not have to "hard wire" (connecting of loose wires from the fan to loose and exposed live wire leads/ends coming from power source) to provide electrical power to the fan/light. The electrical mounting bracket assembly 700, 1200 for ceiling fans now supplies and provides a much safer and secure power supply source to the fan, light, and remote controls while at the same time mounting the fan to the ceiling with a simple twist lock or other type of interlocking method/movement/structure that can engage the two parts (below-the-ceiling junction box 100 and cover 400). The industry knowledge that this presently inventive novel device and method for a safer and easier installation of ceiling fans is available will also help increase market sales for new fan purchases and for the replacement of older, broken, or outdated fans.

The present invention relates to an alignable single-step mechanical/electrical mounting assembly designed to simplify the installation of electrical devices, such as lighting fixtures, ceiling fans, or the like, while ensuring proper alignment with a reference point in the room, such as a wall or ceiling surface. The mounting assembly integrates both mechanical and electrical coupling features, allowing for efficient and secure installation in a single-step process.

Figure 13:
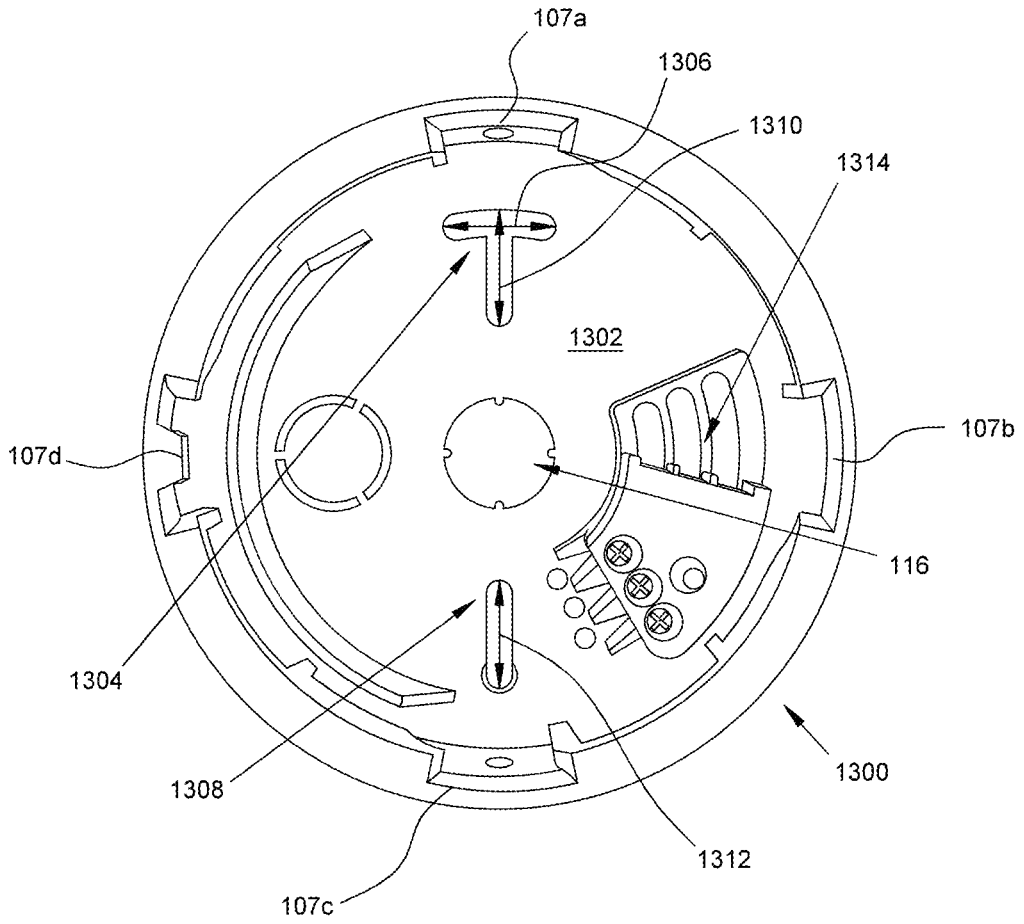
FIG. 13 is a planar view of a below-the-ceiling junction box 1300 that is attachable to a wall, ceiling, or other mounting surface, in accordance with the present invention.

Referring to FIG. 13, the below-the-ceiling junction box 1300 is designed to provide a structural mounting surface and electrical connection point for the assembly. The junction box 1300 features a substrate mounting surface 1302 that facilitates attachment of the below-the-ceiling junction box 1300 to a wall or ceiling. A wall or ceiling can include other surfaces as well, such as cabinets or other structures that can hold electrical apparatuses.

Figure 14:
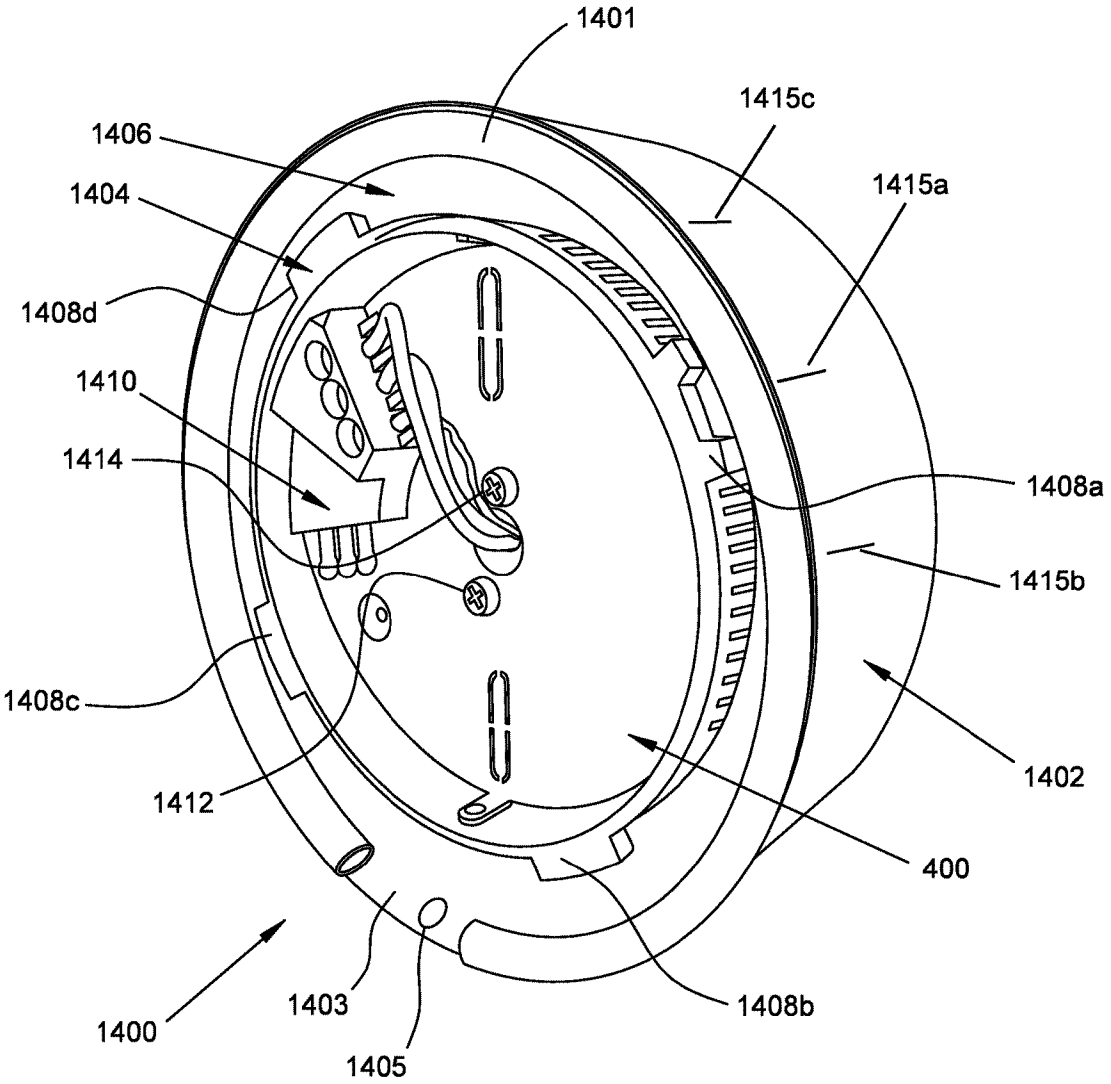
FIG. 14 is a perspective view of interior mounting bracket within a mounting cover, in accordance with the present invention.

A first mount opening 1308 is formed within the substrate mounting surface 1302 and is specifically sized and shaped to accommodate a first mounting member 1412 (shown in FIG. 14). The first mounting member 1412 provides structural support and stability when attaching a cover assembly 1400 (shown in FIG. 14) to the below-the-ceiling junction box 1300.

A second mount opening 1304 is also formed within the substrate mounting surface 1302. The second mount opening 1304 is shaped to receive a second mounting member 1414 (shown in FIG. 14). The second mounting member 1414, in combination with the first mounting member 1412, further enhances the secure mounting of the cover assembly 1400. The second mounting opening 1304, in the embodiment shown in FIG. 13, has a "T" shape with a width 1306 and a length 1310. The length 1310 substantially matches a length 1312 of the first mount opening 1308. The lengths 1310 and 1312 allow the installer to adjust the position of the below-the-ceiling junction box 1300 with reference to the first and second mounting members 1412 and 1414, respectively. The width 1306 of the second mounting mount opening 1304 runs perpendicular to the lengths 1310 and 1312 and allows the installer to adjust the, i.e., rotate, the below-the-ceiling junction box 1300 slightly once the first mounting member 1412 is in the first mount opening 1312 and the second mounting member 1414 is in the second mount opening 1304.

Referring now to FIG. 14, a cover assembly 1400 is shown and includes multiple elements that together form the connection point between the below-the-ceiling junction box 1300 and the electrical device. The cover assembly 1400 includes both mechanical and electrical coupling mechanisms to facilitate proper alignment and connection of the device with minimal effort.

A mounting cover 1402 is the external face of the assembly and is visible after installation. It is designed to aesthetically cover the below-the-ceiling junction box 1300 and provide a mounting surface for the electrical device, such as a light fixture or electrical outlet.

The interior mounting bracket 1404 is positioned within the mounting cover 1402 and serves as the connection interface between the below-the-ceiling junction box 1300 and the cover assembly 1400. The interior mounting bracket 1404 is rotationally selectively securable to the interior 1406 of the mounting cover 1402, meaning it can be rotated and secured in various positions within the mounting cover 1402, allowing for the precise alignment of the electrical device with a reference point, e.g., the ceiling or wall.

The interior mounting bracket 1404 includes the second half of the mechanical couple (1408*a-d*), which is shaped to mate with the first half of the mechanical couple 107*a-d* located on the below-the-ceiling junction box 1300. This mechanical coupling ensures the cover assembly 1400 is securely fastened to the below-the-ceiling junction box 1300 while allowing for rotational adjustment to achieve proper alignment.

In addition to the mechanical coupling, the interior mounting bracket also houses the second half of the electrical couple 1410, which is designed to electrically connect with the first half of the electrical couple 112 located in the below-the-ceiling junction box 1300. As the mechanical halves are mated, the electrical halves also engage, establishing a secure and reliable electrical connection between the below-the-ceiling junction box 1300 and the mounted electrical device.

FIG. 14 also shows a gasket 1401 that surrounds a lip of the mounting cover 1402. The gasket 1401 is optional and can be made of a soft, waterproof/water-resistant material, such as rubber and is particularly useful when the assembly 1400 is mounted on an exterior of a building, e.g., a porch light. The gasket 1401 can seal the junction between the wall and the mounting cover 1402 to prevent water intrusion. The gasket 1401 can also have a gap 1403 that allows any moisture that has intruded the junction between the wall and the gasket 1401 of the mounting cover 1402 to escape. In addition, the mounting cover 1402 can have a weep hole 1405 that also allows moisture that has intruded the junction between the wall and the gasket 1401 and mounting cover 1402 to escape. The weep hole 1405 can be in addition to the gap 1403 of the gasket 1401 or instead of.

The cover assembly includes at least one mounting member 1412, 1414 with is/are used to secure the interior mounting bracket 1404 to the mounting cover 1402. These mounting members 1412, 1414 allow for the bracket 1404 to be rotationally adjusted and locked into place within the mounting cover 1402, ensuring the electrical device attached to the cover assembly is properly aligned with the surrounding environment. The term "aligned" means that, with respect to a chosen longitudinal dimension of a device, it is substantially parallel to a ceiling or floor or perpendicular to a wall. The term "aligned" is well known in the art and should not vary from the commonly understood method of aligning a lighting structure so that it looks "straight," with reference to its environment.

As shown in FIG. 14, at least one indicator 1415*a* appears on an outer surface of the cover assembly 1400, the indicator being positioned at a location where alignment between the indicator 1415 and the interior mounting bracket 1404 results in alignment with the electrical device coupled to the mounting cover 1402 and the wall or ceiling, after the second half of the mechanical couple 1408 mates with the first half of the mechanical couple 107 and the second half of the electrical couple 1410 electrically couples with the first half of the electrical couple 1314. In some embodiments, the at least one indicator 1415*a* is at least three indicators 1415*a-c* on the outside surface of the cover assembly 1400 and each of the at least three indicators 1415*a-c* are positioned at locations where alignment between one of the at least three indicators 1415*a-c* and the interior mounting bracket 1404 results in a different alignment between the electrical device coupled to the mounting cover 1402 and the wall or ceiling, after the second half of the mechanical couple 1408 mates with the first half of the mechanical couple 107 and the second half of the electrical couple 1410 electrically couples with the first half of the electrical couple 1314.

Figure 15:
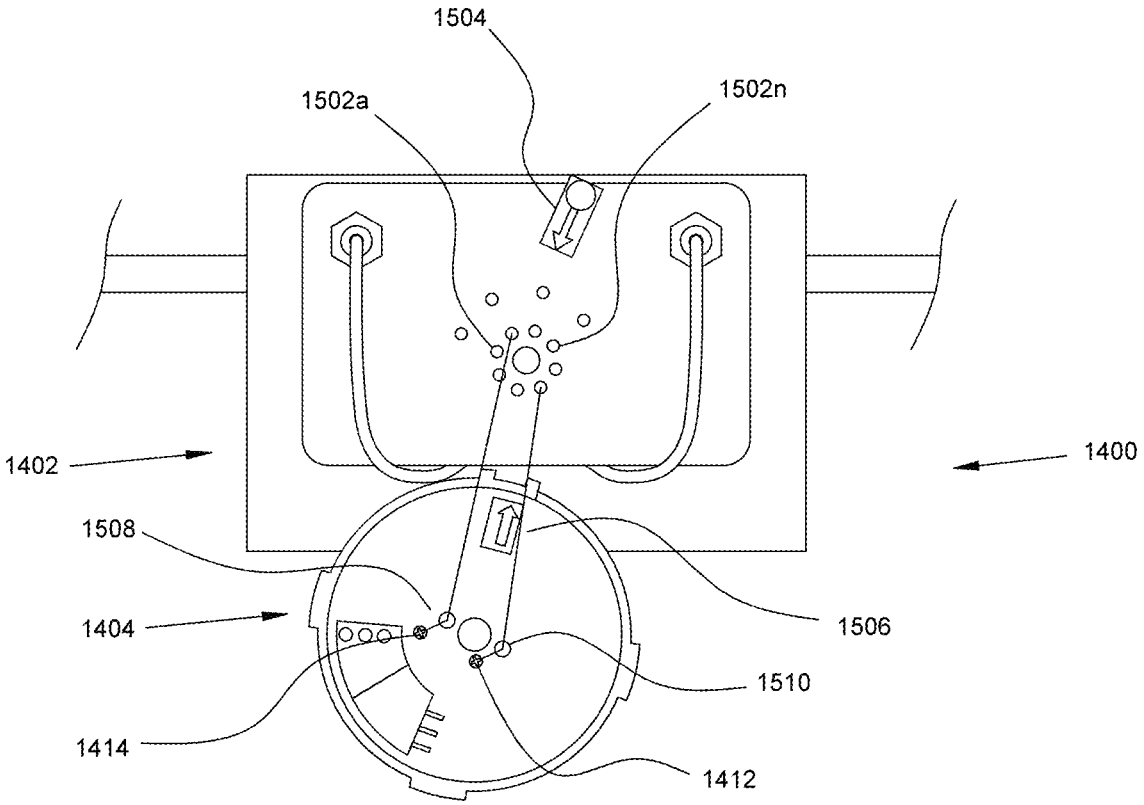
FIG. 15 is an elevational view of the interior mounting bracket being moved into position inside the mounting cover, in accordance with the present invention.

More specifically, as shown in FIG. 15, the mounting cover 1402 is shown as a rectangular structure with a plurality of alignment holes 1502*a-n*, where n can be any number greater than zero. The alignment holes 1502*a-n* are shaped to receive mounting members 1412, 1414 that also pass through holes 1508, 1510 in the interior mounting bracket 1404. The mounting members 1412, 1414 secure the interior mounting bracket 1404 to the mounting cover 1402, as illustrated in FIG. 16.

Figure 16:
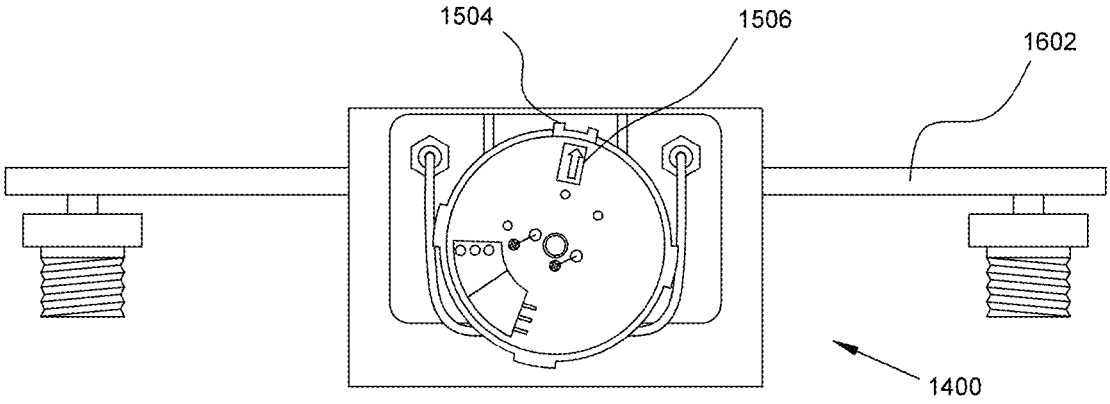
FIG. 16 is an elevational view of the interior mounting bracket in position and fixedly coupled inside the mounting cover, in accordance with the present invention.

In the embodiment shown in FIGS. 15 & 16, an alignment marker 1506 of the interior mounting bracket 1404 is used to ensure alignment with an alignment marker 1504 of the mounting cover 1402. The alignment markers 1504, 1506 provide an indicator to the installer as to where the mounting cover 1402 and interior mounting bracket 1404 should be coupled for installations where the junction box 1300 is properly mounted and aligned with a point of reference, e.g., a ceiling or wall. For other situations, e.g., the junction box 1300 is not installed properly, one or both of the alignment markers 1504, 1506 can be relocated, so that when the mounting cover 1402 and interior mounting bracket 1404 are coupled to each other, the electrical device 1602 will be aligned with a point of reference, e.g., a ceiling or wall.

The alignable single-step mechanical/electrical mounting assembly is designed to simplify the process of installing electrical devices by combining mechanical and electrical coupling into a single step. During installation, the cover assembly 1400 is aligned with the below-the-ceiling junction box 1300, allowing the second half of the mechanical couple 1408*a-d* to mate with the first half of the mechanical couple 107*a-d*, securing the cover assembly 1400 in place. Simultaneously, the second half of the electrical couple 1410 engages with the first half of the electrical couple 112, establishing an electrical connection between the junction box and the electrical device.

The first half of the mechanical couple 107*a-d* is located within the junction box 1300. It provides the primary mechanical interface that ensures the cover assembly 1400 is securely fastened to the below-the-ceiling junction box 1300. This mechanical coupling is specifically designed to mate with a corresponding second half of the mechanical couple 1408*a-d* found on the interior mounting bracket 1404 of the cover assembly 1400.

The first half of the electrical couple 1314 is also incorporated within the below-the-ceiling junction box 1300 and is responsible for providing electrical connectivity to the mounted electrical device. This component is designed to electrically engage with a second half of the electrical couple 1410 positioned on the cover assembly 1400 when the mechanical coupling occurs.

Prior to the mechanical and electrical couplings being engaged, the interior mounting bracket 1404 can be rotationally adjusted within the mounting cover 1402 so that, once the cover assembly 1400 is completely mated to the junction box 1300, the electrical device 1602 will be aligned with a reference point, e.g., a ceiling or wall. This ensures that the device is positioned correctly, regardless of any misalignment of the below-the-ceiling junction box 1300 or surrounding structure. After alignment, the mounting members 1412, 1414 secure the interior mounting bracket 1404 in place, locking the device in the desired orientation.

Figure 17:
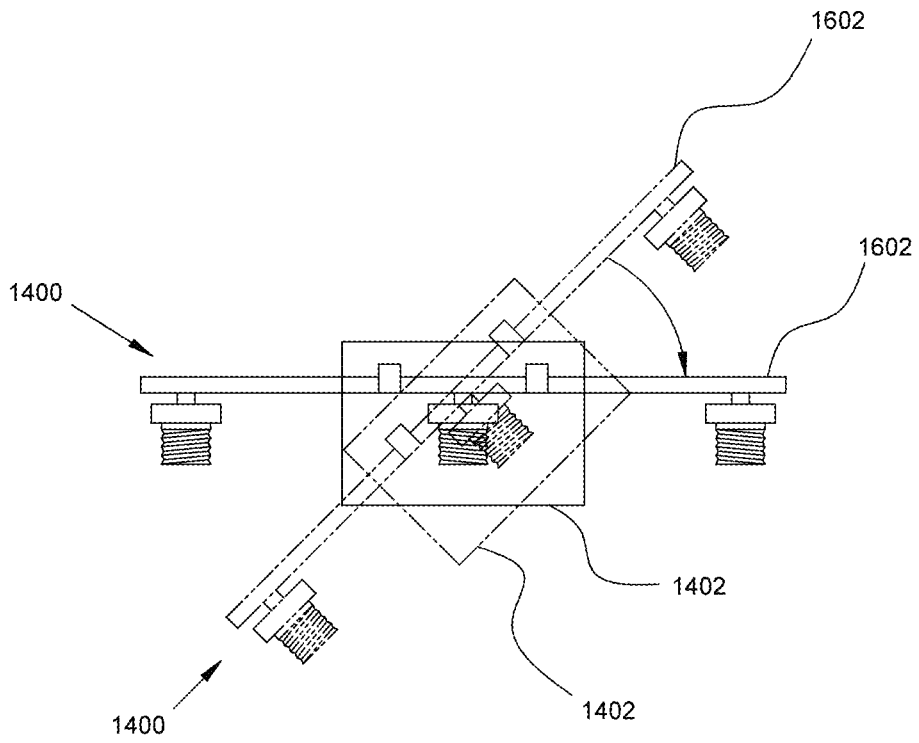
FIG. 17 is an elevational view of a mounting cover and electrical device being attached to a below-the-ceiling junction box in an aligned configuration, in accordance with the present invention.

FIG. 17 illustrates the simplicity of the installation process using the present invention. The entire cover assembly 1400, including a light 1602, is placed over the junction box 1300 (not visible in this view) at an angle of approximately 45 degrees. The entire cover assembly 1400 and light 1602 is then rotated clockwise, approximately 45 degrees. That simple 45 degree turn mechanically couples the cover assembly 1400 to the junction box 1300 and, simultaneously, electrically couples the cover assembly 1400 to the junction box 1300. While doing so, due to the previous selection of the location of the mounting members 1412, 1414 and the alignment holes 1502*a-n*, through which the mounting members 1412, 1414 are attached, the light assembly is selectively aligned with the ceiling, wall, and/or another reference object.

Figure 18:
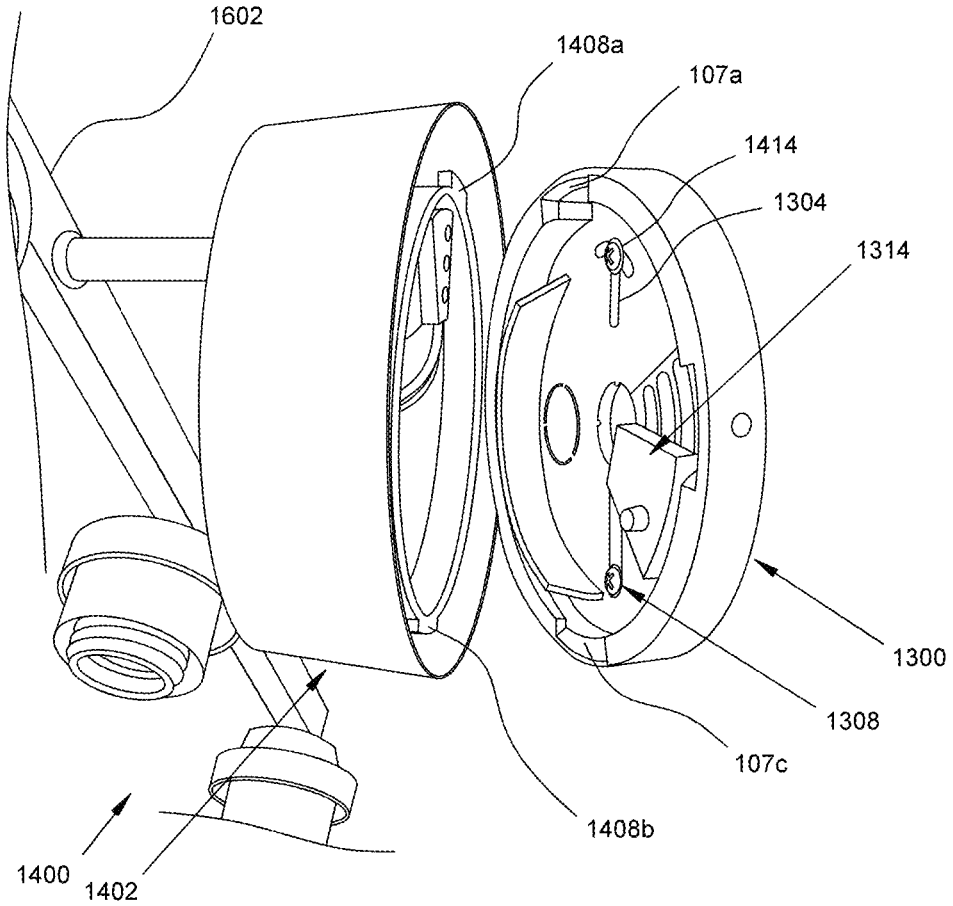
FIG. 18 is a perspective view of a cover assembly being attached to a below-the-ceiling junction box, in accordance with the present invention.

FIG. 18 is a perspective view of the cover assembly 1400 being installed onto the above-the-ceiling junction box 1300. The illustration shows the second half of the mechanical couple 1408*a-d* of the cover assembly 1400 aligned with corresponding ones of the first half of the mechanical couple 107*a-d* of the below-the-ceiling junction box 1300. Once the mechanical couples 1408*a-d* are inserted within the mechanical couples 107*a-d*, the cover assembly 1400 is turned. This movement electrically couples the second half of the electrical couple 1410 to the first half of the electrical couple 1314. Prior to this step, the second mounting member 1414 is placed within the second mount opening 1304 and adjusted for proper alignment. In addition, the interior mounting bracket 1404 is positioned within the mounting cover 1402 in a user-selected alignment (the selection being accomplished as described with reference to FIGS. 14 and 15) that results in the light fixture 1602 being in a user-selected alignment, after full mechanical/electrical coupling between the cover assembly 1400 and the junction box 1300, with a reference object, such as a wall or ceiling.

The result is an efficient, single-step installation process that ensures both mechanical security and electrical connectivity, with the added benefit of adjustable alignment to accommodate various installation conditions.

Figure 19:
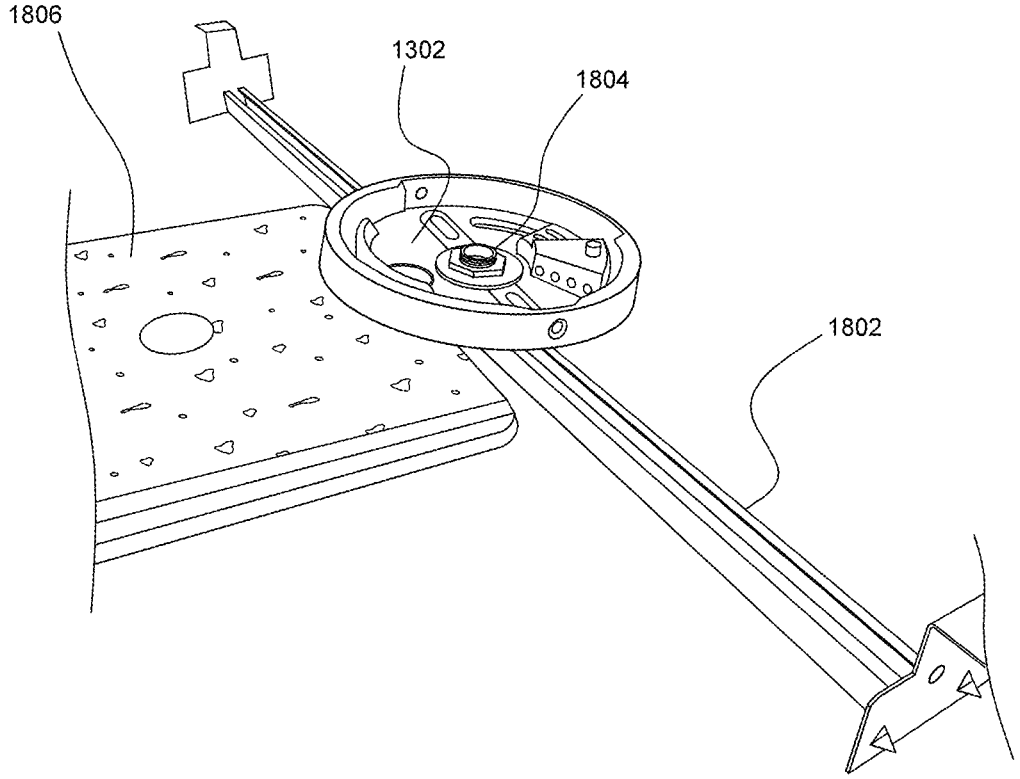
FIG. 19 is a perspective view of a below-the-ceiling junction box being attached to a rail, in accordance with the present invention.

Looking now to FIG. 19, another embodiment of the present invention is shown. Here, the substrate mounting surface 1302 of the below-the-ceiling junction box 1300 has going through it a rail attachment member 1804 that couples the below-the-ceiling junction box 1300 to a rail 1802. The rail attachment member 1804 slidably engages with the rail 1802 and couples the substrate mounting surface 1302 to the rail 1802. The rail 1802 can be used for drop ceilings, which are well known, and that are hidden by tiles 1806. In these types of ceilings, there is no solid structure to attach to, which is why the rail 1802 is beneficial. It provides the support that a drywall ceiling would otherwise provide.

Figure 20:
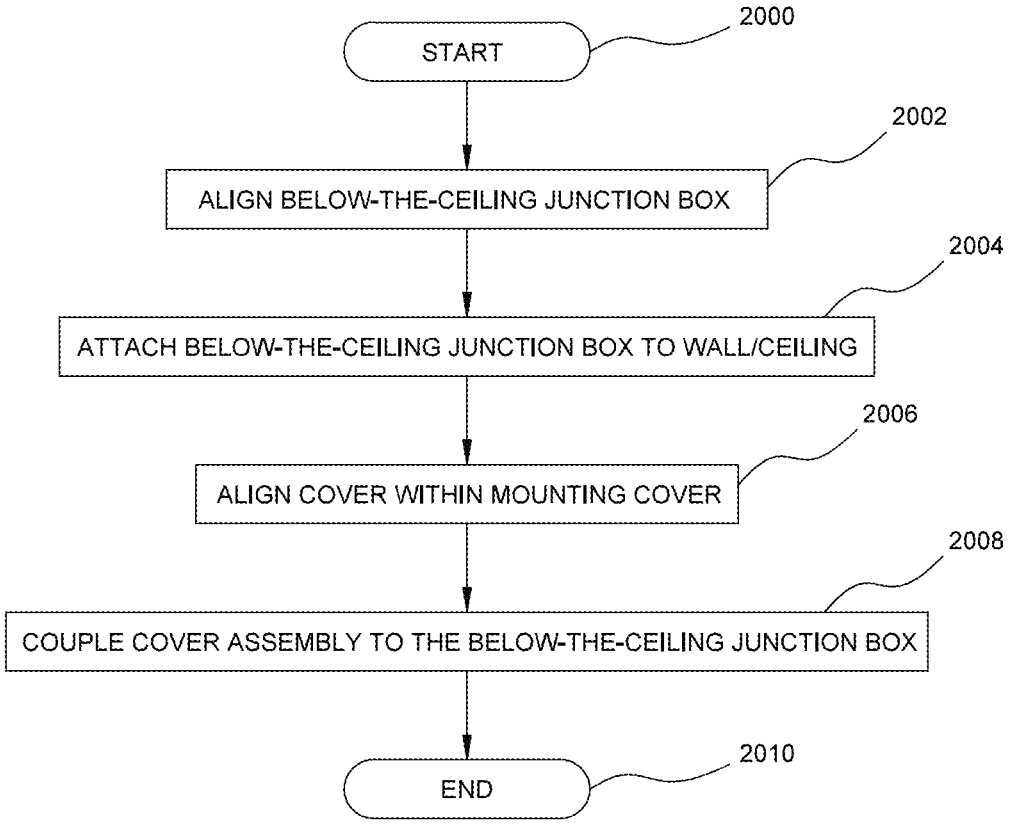
FIG. 20 is a process flow chart of the steps for attaching a cover assembly to a below-the-ceiling junction box in an aligned configuration in accordance with the present invention.

FIG. 20 provides an illustrative flow chart showing a method of aligning the cover assembly 1400 with the below-the-ceiling junction box 1300. The process starts at step 2000 and moves to step 2002 where a user aligns the below-the-ceiling junction box 1300 on a ceiling, wall, or rail and, in step 1204, uses the attachment members 1412 and 1414 to attach the below-the-ceiling junction box 1300 in a desirable alignment. In step 2006, the cover 400 is aligned within the mounting cover 1402 so that, once attached to the below-the-ceiling junction box 1300, the lighting or other electrical fixture will be aligned as desired. In step 2008, the cover assembly 1400 is coupled to the below-the-ceiling junction box 1300. The process ends at step 2010. The claims appended hereto are meant to cover all modifications and changes within the scope and spirit of the present invention.

What is claimed is:

1. An alignable single-step mechanical/electrical mounting assembly comprising:

a below-the-ceiling junction box having:

a substrate mounting surface defining:

a first mounting opening sized and shaped to receive a first mounting member; and a second mounting opening sized and shaped to receive a second mounting member;

a first half of a mechanical couple; and a first half of an electrical couple;

a cover assembly, having:

a mounting cover; and an interior mounting bracket rotationally selectively securable to an interior of the mounting cover, the interior mounting bracket having:

a second half of the mechanical couple that is shaped to mate with the first half of the mechanical couple; and a second half of the electrical couple that electrically couples with the first half of the electrical couple as the second half of the mechanical couple mates with the first half of the mechanical couple; and at least one mounting member selectively securing the interior mounting bracket to the mounting cover at one of at least three user-selectable orientations between the interior mounting bracket and the mounting cover, wherein the interior mounting bracket is operable to be rotationally selectively securable to the interior of the mounting cover at the one of at least three user-selectable orientations between the interior mounting bracket and the mounting cover so that an electrical device coupled to the mounting cover will be aligned with a wall or ceiling after the second half of the mechanical couple mates with the first half of the mechanical couple and the second half of the electrical couple electrically couples with the first half of the electrical couple.

2. The alignable single-step mechanical/electrical mounting assembly according to claim 1, further comprising:

at least one indicator on an outer surface of the cover assembly, the at least one indicator being positioned at a location where alignment between the at least one indicator and the interior mounting bracket results in alignment with the electrical device coupled to the mounting cover and the wall or ceiling, after the second half of the mechanical couple mates with the first half of the mechanical couple and the second half of the electrical couple electrically couples with the first half of the electrical couple.

3. The alignable single-step mechanical/electrical mounting assembly according to claim 2, wherein:

the at least one indicator is at least three indicators on the outer surface of the cover assembly and each of the at least three indicators are positioned at locations where alignment between one of the at least three indicators and the interior mounting bracket results in a different alignment between the electrical device coupled to the mounting cover and the wall or ceiling, after the second half of the mechanical couple mates with the first half of the mechanical couple and the second half of the electrical couple electrically couples with the first half of the electrical couple.

4. The alignable single-step mechanical/electrical mounting assembly according to claim 1, wherein:

the second mounting opening is sized and shaped to slidably engage with the second mounting member in a direction substantially perpendicular to a direction directly towards the first mounting opening.

5. The alignable single-step mechanical/electrical mounting assembly according to claim 1, further comprising:

a rail; and a rail attachment member slidably engaged with the rail and coupling the substrate mounting surface to the rail.

6. The alignable single-step mechanical/electrical mounting assembly according to claim 1, further comprising:

a gasket at least partially surrounding an edge of the mounting cover that mates with the wall or ceiling.

7. The alignable single-step mechanical/electrical mounting assembly according to claim 1, further comprising:

an edge of the mounting cover defining a weep hole.

8. A method for installing an electrical mounting assembly, the method comprising:

providing a below-the-ceiling junction box that includes:

a substrate mounting surface defining:

a first mounting opening sized and shaped to receive a first mounting member; and a second mounting opening sized and shaped to receive a second mounting member;

a first half of a mechanical couple; and a first half of an electrical couple;

providing a cover assembly that includes:

a mounting cover; and an interior mounting bracket rotationally selectively securable to an interior of the mounting cover, the interior mounting bracket having:

a second half of the mechanical couple that is shaped to mate with the first half of the mechanical couple; and a second half of the electrical couple that electrically couples with the first half of the electrical couple as the second half of the mechanical couple mates with the first half of the mechanical couple; and attaching the substrate mounting surface of the below-the-ceiling junction box to a substrate; and rotationally selectively securing the interior mounting bracket to the interior of the mounting cover in a user-selectable orientation with respect to a rotational alignment between the interior mounting bracket and the mounting cover so that an electrical device coupled to the mounting cover will be aligned with a wall or ceiling after the second half of the mechanical couple mates with the first half of the mechanical couple and the second half of the electrical couple electrically couples with the first half of the electrical couple.

9. The method according to claim 8, further comprising:

positioning at least one indicator on an outer surface of the cover assembly at a location where alignment between the indicator and the interior mounting bracket results in alignment with the electrical device coupled to the mounting cover and the wall or ceiling, after the second half of the mechanical couple mates with the first half of the mechanical couple and the second half of the electrical couple electrically couples with the first half of the electrical couple.

10. The method according to claim 9, wherein:

the at least one indicator is at least three indicators on the outer surface of the cover assembly and each of the at least three indicators are positioned at locations where alignment between one of the at least three indicators and the interior mounting bracket results in a different alignment between the electrical device coupled to the mounting cover and the wall or ceiling, after the second half of the mechanical couple mates with the first half of the mechanical couple and the second half of the electrical couple electrically couples with the first half of the electrical couple.

11. The method according to claim 8, wherein the step of attaching the substrate mounting surface of the below-the-ceiling junction box to a substrate comprises:

placing the below-the-ceiling junction box against the substrate;

inserting the first mounting member through the first mounting opening and into the substrate;

inserting the second mounting member through the second mounting opening and into the substrate;

slidably adjusting the below-the-ceiling junction box relative to the first mounting member to achieve a desired alignment; and fixedly attaching the below-the-ceiling junction box to the substrate by tightening the first mounting member.

12. The method according to claim 8, wherein:

the substrate is a rail and the method includes the steps of:

attaching the below-the-ceiling junction box to the rail with a rail attachment member;

sliding the below-the-ceiling junction box to a desired position along the rail; and securing the below-the-ceiling junction box to the rail with the rail attachment member.

13. The method according to claim 8, further comprising:

providing a gasket at an edge of the mounting cover.

14. An alignable single-step mechanical/electrical mounting assembly comprising:

a junction box having:

a first half of a mechanical couple; and a first half of an electrical couple;

a cover assembly, having:

a mounting cover; and an interior mounting bracket rotationally selectively securable to an interior of the mounting cover at at least three alignment positions, wherein each of the at least three alignment positions can be selected as a locked alignment position to align the mounting cover with an environment relative to the cover assembly, the interior mounting bracket having:

a second half of the mechanical couple that is shaped to engage with the first half of the mechanical couple; and a second half of the electrical couple that is shaped to engage with the first half of the electrical couple.

15. The alignable single-step mechanical/electrical mounting assembly according to claim 14, wherein:

when the interior mounting bracket is selectively secured to the interior of the mounting cover and the second half of the mechanical couple mates with the first half of the mechanical couple and the second half of the electrical couple electrically couples with the first half of the electrical couple, an electrical device coupled to the mounting cover is aligned with a wall, ceiling, or floor.

16. The alignable single-step mechanical/electrical mounting assembly according to claim 14, further comprising:

at least one indicator on an outer surface of the cover assembly, the at least one indicator being positioned at a location where alignment between the indicator and the at least one indicator mounting bracket results in alignment with the electrical device coupled to the mounting cover and a wall or ceiling, after the second half of the mechanical couple mates with the first half of the mechanical couple and the second half of the electrical couple electrically couples with the first half of the electrical couple.

* * * * *